US010176918B2

(12) United States Patent
Ishida et al.

(10) Patent No.: US 10,176,918 B2
(45) Date of Patent: Jan. 8, 2019

(54) ELECTRONIC COMPONENT AND MANUFACTURING METHOD FOR SAME

(71) Applicant: MURATA MANUFACTURING CO., LTD., Kyoto-fu (JP)

(72) Inventors: Kosuke Ishida, Nagaokakyo (JP); Mizuho Katsuta, Nagaokakyo (JP); Jun Karino, Nagaokakyo (JP); Yoichi Nakatsuji, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/371,657

(22) Filed: Dec. 7, 2016

(65) Prior Publication Data

US 2017/0169936 A1 Jun. 15, 2017

(30) Foreign Application Priority Data

Dec. 14, 2015 (JP) ..... 2015-242923

(51) Int. Cl.
*H01F 5/00* (2006.01)
*H01F 27/28* (2006.01)
(Continued)

(52) U.S. Cl.
CPC ..... *H01F 27/292* (2013.01); *H01F 27/245* (2013.01); *H01F 27/255* (2013.01);
(Continued)

(58) Field of Classification Search
None
See application file for complete search history.

(56) References Cited

U.S. PATENT DOCUMENTS

2014/0139307 A1* 5/2014 Kido ..... H01F 27/2804 336/192

FOREIGN PATENT DOCUMENTS

CN 103703524 A 4/2014
JP 2005-072065 A 3/2005
(Continued)

OTHER PUBLICATIONS

Notification of the First Office Action issued by the State Intellectual Property Office of the People's Republic of China dated Jan. 31, 2018, which corresponds to Chinese Patent Application No. 201610942640.3 and is related to U.S. Appl. No. 15/371,657.

*Primary Examiner* — Ronald Hinson
(74) *Attorney, Agent, or Firm* — Studebaker & Brackett PC

(57) ABSTRACT

An electronic component includes a first ceramic substrate having a first principal surface on the upper side and a second principal surface on the lower side, a multilayer body constituted by a plurality of insulator layers each made of a material containing resin and laminated on the first principal surface, a first coil disposed in and/or on the multilayer body, a first relay conductor connected to the first coil, and a first outer electrode disposed on the first ceramic substrate and electrically connected to the first relay conductor. The plurality of insulator layers include one or more first insulator layers in each of which a first corner has a shape cut away as a first cut-away portion, the first relay conductor is disposed in the first cut-away portion, and the plurality of insulator layers include a second insulator layer that is contacted with the first relay conductor from below.

11 Claims, 25 Drawing Sheets

(51) Int. Cl.

| | |
|---|---|
| ***H01F 27/29*** | (2006.01) |
| ***H01F 27/245*** | (2006.01) |
| ***H01F 41/02*** | (2006.01) |
| ***H01F 41/04*** | (2006.01) |
| ***H01F 27/255*** | (2006.01) |

(52) U.S. Cl.
CPC ..... *H01F 27/2804* (2013.01); *H01F 41/0233* (2013.01); *H01F 41/041* (2013.01); *H01F 41/046* (2013.01); *H01F 2027/2809* (2013.01)

(56) References Cited

FOREIGN PATENT DOCUMENTS

| | | | |
|---|---|---|---|
| JP | 2014-192487 | A | 10/2014 |
| JP | 2014-197590 | A | 10/2014 |
| WO | 2013/031880 | A1 | 3/2013 |

* cited by examiner

ELECTRONIC COMPONENT AND MANUFACTURING METHOD FOR SAME

CROSS REFERENCE TO RELATED APPLICATIONS

This application claims benefit of priority to Japanese Patent Application 2015-242923 filed Dec. 14, 2015, the entire content of which is incorporated herein by reference.

TECHNICAL FIELD

The present disclosure relates to an electronic component and a manufacturing method for the electronic component, and more particularly to an electronic component including a coil, and a manufacturing method for the electronic component.

BACKGROUND

As one example of related-art electronic components, there is known an electronic component disclosed in International Publication No. 2013/031880. FIG. 10A is an external perspective view of an electronic component 510 disclosed in International Publication No. 2013/031880.

The electronic component 510 includes magnetic substrates 512*a* and 512*b*, a multilayer body 514, an outer electrode 515*a*, a connecting portion 516*a*, lead-out portions 521*a* and 521*b*, and a coil L501. The magnetic substrate 512*b*, the multilayer body 514, and the magnetic substrate 512*a* are successively laminated to position in the mentioned order from the upper side toward the lower side. The coil L501 is disposed inside the multilayer body 514. The lead-out portions 521*a* and 521*b* are disposed in a portion of the multilayer body 514 where a ridge of the multilayer body 514 is cut away, and they are formed to extend in an up-down direction for connection therebetween. One end of the coil L501 is connected to the lead-out portion 521*a*. The connecting portion 516*a* is disposed in a portion of the magnetic substrate 512*a* where a ridge of the magnetic substrate 512*a* is cut away, and an upper end of the connecting portion 516*a* is connected to the lead-out portion 521*b*. The outer electrode 515*a* is disposed on a bottom surface of the magnetic substrate 512*a* and is connected to the connecting portion 516*a*.

SUMMARY

In the electronic component 510 constituted as described above, however, there is a possibility that the lead-out portions 521*a* and 521*b* may slip off from the multilayer body 514 as described below. FIG. 10B is a sectional structural view of a part of the electronic component 510, the part including the lead-out portions 521*a* and 521*b* and the vicinity thereof.

The inventors of this application have found the fact that the lead-out portions 521*a* and 521*b* may slip off from the multilayer body 514 in some cases for the reason described below. In more detail, as illustrated in FIG. 10B, the lead-out portion 521*b* is formed directly on an upper surface of the magnetic substrate 512*a*. The magnetic substrate 512*a* is comparatively hard. Therefore, adhesivity of the lead-out portion 521*b* with respect to the magnetic substrate 512*a* is comparatively low. Accordingly, when impacts are applied to the electronic component 510 in a cutting step with a dicing machine and a scribing step to divide a mother substrate into plural pieces each including the magnetic substrates 512*a* and 512*b*, peeling-off may occur between the lead-out portion 521*b* and the magnetic substrate 512*a*, and the lead-out portions 521*a* and 521*b* may slip off from the multilayer body 514. While the impacts applied in the cutting step with the dicing machine and the scribing step have been mentioned above as the cause of the slipping-off of the lead-out portions 521*a* and 521*b*, there is further a possibility that impacts applied, for example, in case of fall of the electronic component 510 may also cause the slipping-off of the lead-out portions 521*a* and 521*b*.

Accordingly, an object of the present disclosure is to provide an electronic component in which a relay conductor disposed in a multilayer body on a ceramic substrate can be suppressed from slipping off from the multilayer body, and a manufacturing method for the electronic component.

According to one embodiment of the present disclosure, there is provided an electronic component including a first ceramic substrate having a substantially rectangular first principal surface that is positioned on one side in a laminating direction, and a substantially rectangular second principal surface that is positioned on the other side in the laminating direction, a multilayer body constituted by a plurality of substantially rectangular parallelepiped insulator layers each made of a material containing resin or glass, the plurality of insulator layers being laminated on the first principal surface in the laminating direction, a first coil disposed in and/or on the multilayer body, a first relay conductor disposed in and/or on the multilayer body and electrically connected to the first coil, and a first outer electrode disposed on one surface of the first ceramic substrate and electrically connected to the first relay conductor, wherein the plurality of insulator layers include one or more first insulator layers in each of which a first corner has a shape cut away as a first cut-away portion, the first relay conductor is disposed in the first cut-away portion, and the plurality of insulator layers include a second insulator layer that is contacted with the first relay conductor from the other side in the laminating direction.

According to another embodiment of the present disclosure, there is provided a manufacturing method for the electronic component, the manufacturing method including a first step of, on each of the first principal surfaces of the plurality of first ceramic substrates arrayed in a first mother substrate, forming a plurality of paste layers, which are to become the plurality of insulator layers, with use of a material containing glass, and forming a coil conductor layer that is to become the first coil and a relay conductor layer that is to become the first relay conductor, thus forming a mother multilayer body in which the plurality of green multilayer bodies in a state not yet fired are arrayed, and a second step of firing the mother multilayer body.

With the embodiments of the present disclosure, the relay conductor disposed in the multilayer body on the ceramic substrate can be suppressed from slipping off from the multilayer body.

Other features, elements, characteristics and advantages of the present disclosure will become more apparent from the following detailed description of the present disclosure with reference to the attached drawings.

DETAILED DESCRIPTION

An electronic component and a manufacturing method for the electronic component, according to an embodiment of the present disclosure, will be described below.

(Configuration of Electronic Component)

Figure 1:
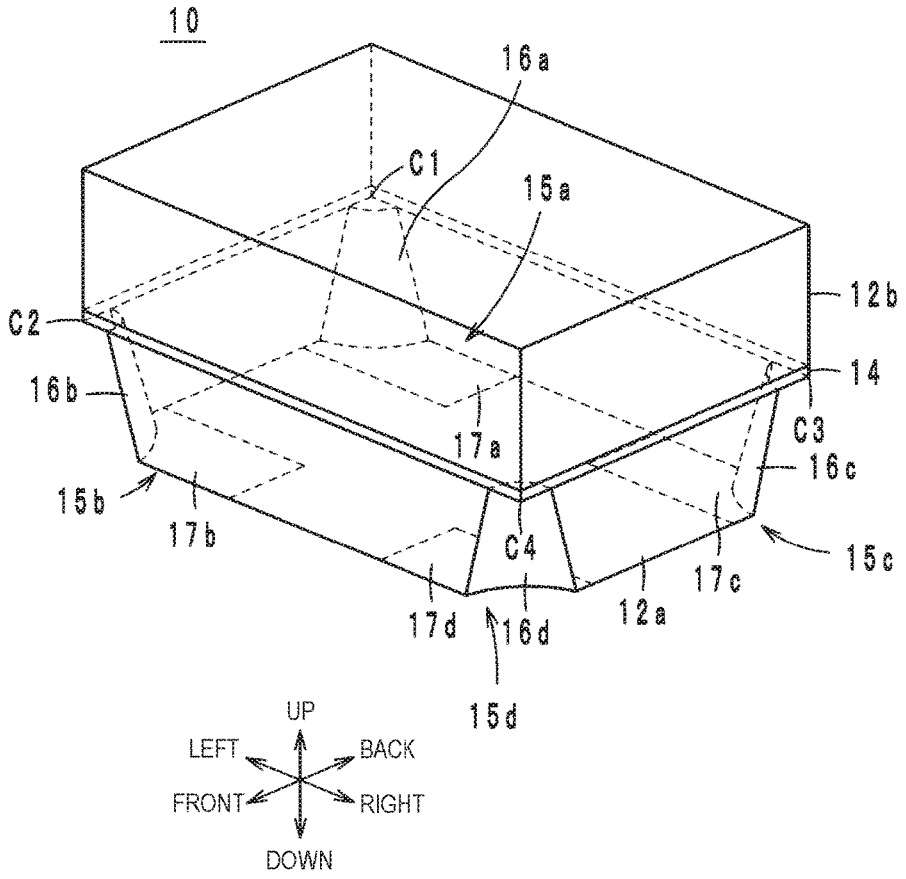
FIG. 1 is an external perspective view of an electronic component according to one embodiment.
Figure 2:
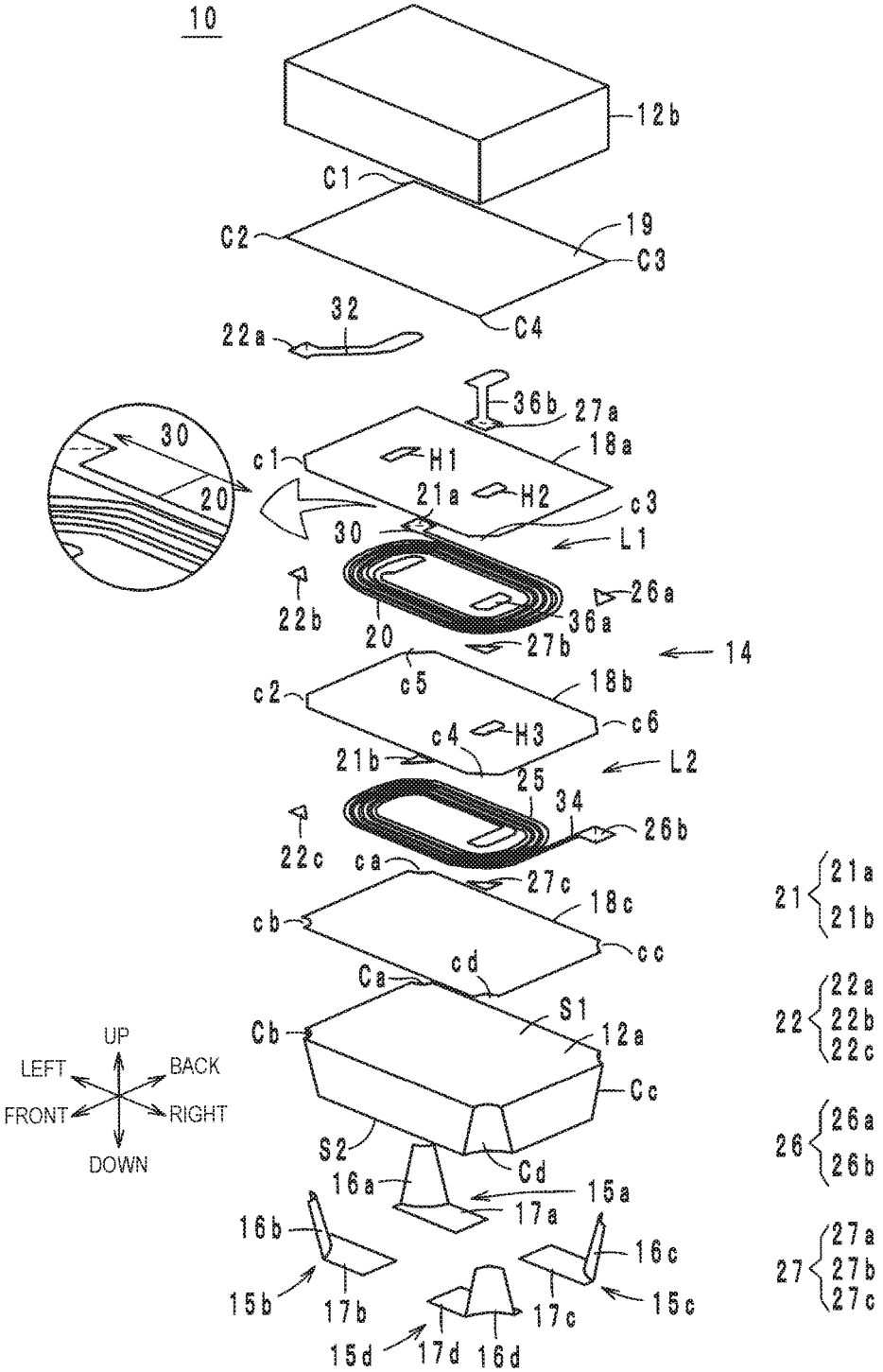
FIG. 2 is an exploded perspective view of the electronic component illustrated in FIG. 1.
Figure 3A:
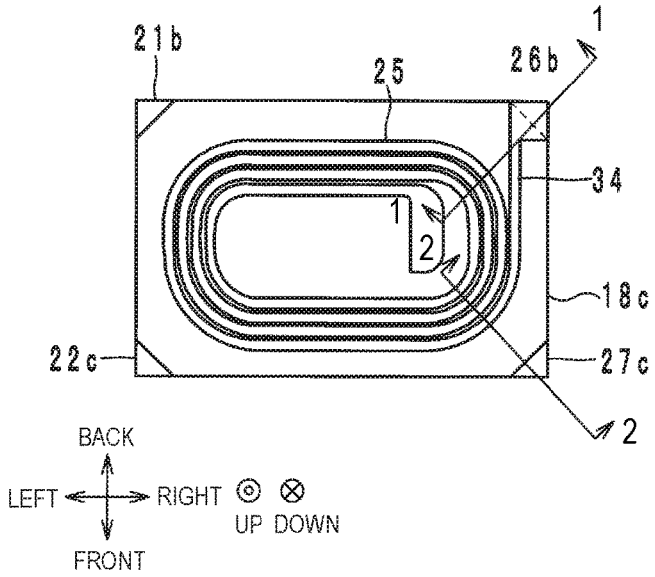
FIG. 3A is a plan view illustrating a coil conductor layer and an insulator layer.
Figure 3B:
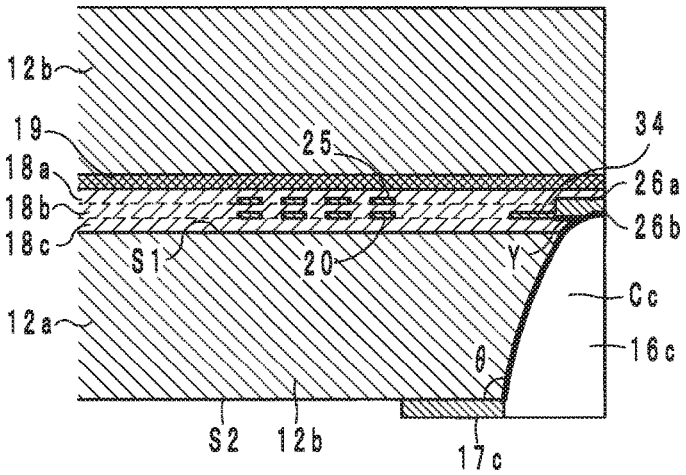
FIG. 3B is a sectional structural view taken along 1-1 in FIG. 3A.
Figure 3C:
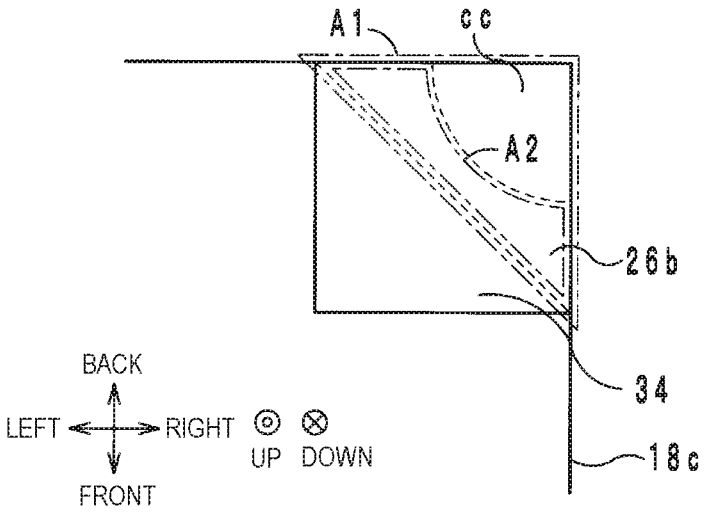
FIG. 3C is a plan view illustrating a relay conductor layer.
Figure 3D:
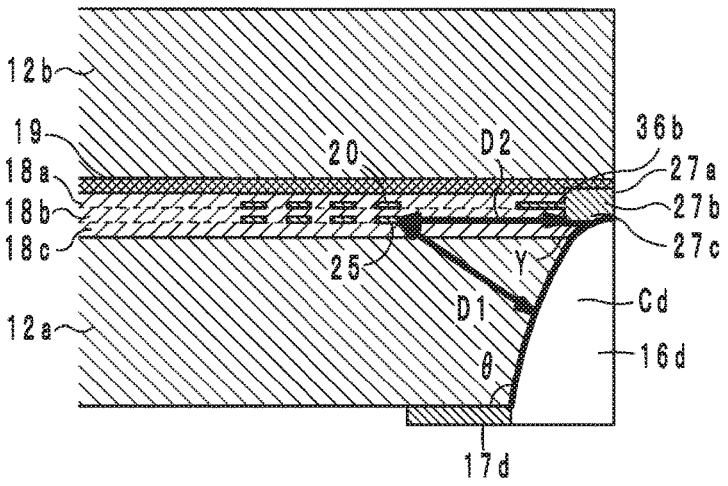
FIG. 3D is a sectional structural view taken along 2-2 in FIG. 3A.

First, a configuration of the electronic component, denoted by 10, according to the embodiment of the present disclosure is described with reference to the drawings. FIG. 1 is an external perspective view of the electronic component 10 according to the embodiment. FIG. 2 is an exploded perspective view of the electronic component 10 illustrated in FIG. 1. FIG. 3A is a plan view illustrating a coil conductor layer 25 and an insulator layer 18*c*. FIG. 3B is a sectional structural view taken along 1-1 in FIG. 3A. FIG. 3C is a plan view illustrating a relay conductor layer 26*b*. FIG. 3D is a sectional structural view taken along 2-2 in FIG. 3A. In the following description, a laminating direction of the electronic component 10 is defined as an up-down direction, a direction in which a long side of the electronic component 10 extends when viewed from above is defined as a left-right direction, and a direction in which a short side of the electronic component 10 extends when viewed from above is defined as a front-back direction. The up-down direction, the left-right direction, and the front-back direction are orthogonal to one another.

As illustrated in FIGS. 1 and 2, the electronic component 10 includes magnetic substrates 12*a* and 12*b*, a multilayer body 14, outer electrodes 15*a* to 15*d*, an organic adhesive layer 19, relay conductors 21, 22, 26 and 27, and coils L1 and L2.

The magnetic substrate 12*a* (one example of a first ceramic substrate) is in the form of a substantially rectangular parallelepiped having principal surfaces S1 and S2 that are substantially rectangular. The principal surface S1 (one example of a first principal surfaces) is a principal surface positioned on the upper side (one example of one side in the laminating direction), and the principal surface S2 (one example of a second principal surfaces) is a principal surface positioned on the lower side (one example of the other side in the laminating direction). However, as described later, the magnetic substrate 12*a* has a shape that four ridges connecting the principal surfaces S1 and S2 to each other are cut away in cut-away portions Ca to Cd (each being one example of a second cut-away portion). The concept implied by "substantially rectangular" represents shapes including a substantially square shape, but also a shape obtained by cutting away corners of a substantially rectangular shape.

The magnetic substrate 12*a* is made of a magnetic material. In this embodiment, the magnetic substrate 12*a* is fabricated by cutting a ferrite ceramic that has been fired. Alternatively, the magnetic substrate 12*a* may be fabricated by coating a paste, which is made of calcined ferrite powder and a binder, over a ceramic substrate made of, e.g., alumina, and firing the coated paste, or by laminating green sheets each made of a ferrite material one above another, and firing the laminated green sheets.

The multilayer body 14 includes insulator layers 18*a* to 18*c* (one example of a plurality of insulator layers) and has a substantially rectangular shape when viewed from above. A corner C1 is a corner of the multilayer body 14 on the back left side. A corner C2 is a corner of the multilayer body 14 on the front left side. A corner C3 is a corner of the multilayer body on the back right side. A corner C4 is a corner of the multilayer body 14 on the front right side. It is to be noted that the corners C1 to C4 are imaginary corners because corners of each of the insulator layers 18*a* to 18*c* in the multilayer body 14 are cut away.

The insulator layers 18*a* to 18*c* are laminated on the principal surface S1 to array in the mentioned order from the upper side toward the lower side, and they have a substantially rectangular parallelepiped shape and the principal surfaces thereof are substantially the same size and shape as the principal surface S1. However, the insulator layer 18*a* (one example of a fourth insulator layer) has a shape that the corners C2 and C4 (the corner C4 being one example of a second corner) are cut away respectively as cut-away portions c1 and c3 (the cut-away portion c3 being one example of a third cut-away portion). The insulator layer 18*b* (one example of a first insulator layer, the fourth insulator layer, or a fifth insulator layer) has a shape that the corners C1 to C4 (the corner C3 being one example of a first corner, the corner C4 being one example of the second corner, and the corner C1 being one example of a third corner) are cut away respectively as cut-away portions c2 and c4 to c6 (the cut-away portion c6 being one example of a first cut-away portion, the cut-away portion c4 being one example of the third cut-away portion, and the cut-away portion c5 being one example of a fourth cut-away portion). The cut-away portions c1 to c6 are portions each having the shape of a substantially isosceles right triangle in which the insulator layers 18*a* and 18*b* are cut away with respect to a substantially rectangular upper surface of the electronic component 10 when viewed from above. Thus, the insulator layers 18*a* to 18*c* include the insulator layer 18*a* (one example of the fourth insulator layer) having the shape that the corners C2 and C4 are cut away respectively as the cut-away portions c1 and c3, and the insulator layer 18*b* (one example of the first insulator layer, the fourth insulator layer, or the fifth insulator layer) having the shape that the corners C1 to C4 are cut away respectively as the cut-away portions c2 and c4 to c6.

Cut-away portions ca to cd are formed respectively at the corners C1 to C4 of the insulator layer 18*c*. However, the cut-away portions ca to cd are formed together with later-described cut-away portions Ca to Cd in a continuous relation, respectively, and they are different from the cut-away portions c1 to c6. Accordingly, each of the cut-away portions ca to cd of the insulator layer 18*c* has a substantially sector shape with a center angle of about 90° instead of the shape of a substantially isosceles right triangle.

Furthermore, via holes H1 and H2 are formed in a state penetrating the insulator layer 18*a* in the up-down direction. A via hole H3 is formed in a state penetrating the insulator layer 18*b* in the up-down direction. The via hole H3 and the via hole H2 are communicated with each other.

The insulator layers 18*a* to 18*c* are made of polyimide. Alternatively, the insulator layers 18*a* to 18*c* may be made of a material containing an insulating resin such as benzocyclobutene. Anyway, the insulator layers 18*a* to 18*c* are preferably made of a material containing an insulating resin as a main ingredient. In the following, a principal surface of each of the insulator layers 18*a* to 18*c* on the upper side is called a front surface, and a principal surface of each of the insulator layers 18*a* to 18*c* on the lower side is called a rear surface.

The magnetic substrate 12*b* (one example of a second ceramic substrate) is in the form of a substantially rectangular parallelepiped, and it sandwiches the multilayer body 14 in cooperation with the magnetic substrate 12*a* in the up-down direction. In other words, the magnetic substrate 12*b* is laminated on the upper side of the multilayer body 14. The magnetic substrate 12*b* is made of a magnetic material. In this embodiment, the magnetic substrate 12*b* is fabricated by cutting a ferrite ceramic that has been fired. Alternatively, the magnetic substrate 12*b* may be fabricated by coating a paste, which is made of calcined ferrite powder and a binder, over a ceramic substrate made of, e.g., alumina, and firing the coated paste, or by laminating green sheets each made of a ferrite material one above another, and firing the laminated green sheets.

The organic adhesive layer 19 bonds the magnetic substrate 12*b* and the multilayer body 14 to each other.

The coil L1 (one example of a second coil) is disposed inside the multilayer body 14, and it includes a coil conductor layer 20 and lead-out conductors 30 and 32. The coil conductor layer 20 is disposed on the front surface of the insulator layer 18*b*, and it has a substantially spiral shape gradually approaching a center thereof while circling clockwise when viewed from above. The center of the coil conductor layer 20 is substantially aligned with a center (crossed point of diagonal lines) of the electronic component 10 when viewed from above.

The lead-out conductor 30 is disposed on the front surface of the insulator layer 18*b* such that the lead-out conductor 34 extends leftward from an outer end portion of the coil conductor layer 20, and that it is led out to the corner C1 of the insulator layer 18*b* on the back left side. Therefore, the lead-out conductor 30 does not have the substantially spiral shape when viewed from above. Thus, as illustrated in an enlarged view in FIG. 2, a boundary between the coil conductor layer 20 and the lead-out conductor 30 is located at a position where the lead-out conductor 30 departs from the locus of the substantially spiral shape formed by the coil conductor layer 20. A boundary between a coil conductor layer 25 (described later) and a lead-out conductor 34 (described later) is also located similarly to the boundary between the coil conductor layer 20 and the lead-out conductor 30.

The lead-out conductor 32 is disposed on the front surface of the insulator layer 18*a* and within the via hole H1. A back end portion of the lead-out conductor 32 penetrates the insulator layer 18*a* through the via hole H1 in the up-down direction to be connected to an inner end portion of the coil conductor layer 20. Moreover, the lead-out conductor 32 extends on the front surface of the insulator layer 18*a* toward the front left side from the via hole H1 to be led out to the corner C2 of the insulator layer 18*a* on the front left side. Accordingly, the lead-out conductor 32 does not have the substantially spiral shape when viewed from above.

The relay conductor 21 (one example of a third relay conductor) is electrically connected to the coil L1 and is disposed in the cut-away portion c5 (i.e., at the corner C1). In more detail, the relay conductor 21 has the shape of a substantially isosceles right triangle when viewed from above, which is identical to the shape of the cut-away portion c5, and includes relay conductor layers 21*a* and 21*b*. The relay conductor layers 21*a* and 21*b* are connected in the mentioned order from the upper side to the lower side, and they have the same shape when viewed from above.

The relay conductor layer 21*a* is a conductor layer disposed in the cut-away portion c5, having the shape of a substantially isosceles right triangle, and extending from the front surface of the insulator layer 18*b* to the front surface of the insulator layer 18*c* in the up-down direction. However, the relay conductor layer 21*a* projects upward from the front surface of the insulator layer 18*b* by a distance corresponding to one layer. Furthermore, the relay conductor layer 21*a* is connected to a left end portion of the lead-out conductor 30 to provide a substantially square shape, when viewed from above, in combination with the left end portion of the lead-out conductor 30. Thus, the relay conductor 21 is electrically connected to the outer end portion of the coil conductor layer 20. The relay conductor layer 21*b* is a conductor layer disposed on the front surface of the insulator layer 18*c* and having the shape of a substantially isosceles right triangle. However, the relay conductor layer 21*b* is not positioned in the cut-away portion ca that is formed in the insulator layer 18*c*.

The relay conductor 22 is electrically connected to the coil L1 and is disposed in the cut-away portions c1 and c2 (i.e., at the corner C2). In more detail, the relay conductor has the shape of a substantially isosceles right triangle when viewed from above, which is identical to the shape of each of the cut-away portions c1 and c2, and includes relay conductor layers 22*a* to 22*c*. The relay conductor layers 22*a* to 22*c* are connected in the mentioned order from the upper side to the lower side, and they have the same shape when viewed from above.

The relay conductor layer 22*a* is a conductor layer disposed in the cut-away portion c1, having the shape of a substantially isosceles right triangle, and extending from the front surface of the insulator layer 18*a* to the front surface of the insulator layer 18*b* in the up-down direction. However, the relay conductor layer 22*a* projects upward from the front surface of the insulator layer 18*a* by a distance corresponding to one layer. Furthermore, the relay conductor layer 22*a* is connected to a front-left end portion of the lead-out conductor 32 to provide a substantially square shape, when viewed from above, in combination with the left end portion of the lead-out conductor 32. Thus, the relay conductor 22 is electrically connected to the inner end portion of the coil conductor layer 20. The relay conductor layer 22*b* is a conductor layer disposed in the cut-away portion c2, having the shape of a substantially isosceles right triangle, and extending from the front surface of the insulator layer 18*b* to the front surface of the insulator layer 18*c* in the up-down direction. The relay conductor layer 22*c* is a conductor layer disposed on the front surface of the insulator layer 18*c* and having the shape of a substantially isosceles right triangle. However, the relay conductor layer 22*c* is not positioned in the cut-away portion cb that is formed in the insulator layer 18*c*.

The coil L2 (one example of a first coil) is disposed inside the multilayer body 14, and it includes a coil conductor layer 25 and lead-out conductors 34, 36*a* and 36*b*. The coil conductor layer 25 is disposed on the front surface of the insulator layer 18*c*, and it has a substantially spiral shape gradually approaching a center thereof while circling clockwise when viewed from above. In other words, the coil conductor layer 25 circles in the same direction as the coil conductor layer 20. The center of the coil conductor layer 25 is substantially aligned with the center (crossed point of the diagonal lines) of the electronic component 10 when viewed from above. Thus, the coil conductor layer 25 overlaps the coil conductor layer 20 when viewed from above. Moreover, the coil conductor layer 25 is disposed on the lower side of the coil conductor layer 20. With the above arrangement, the coil L2 is magnetically coupled to the coil L1 to constitute a common-mode choke coil in combination with the coil L1.

The lead-out conductor 34 is disposed on the front surface of the insulator layer 18*c* such that the lead-out conductor 34 extends backward from an outer end portion of the coil conductor layer 25, and that it is led out to the corner C3 of the insulator layer 18*c* on the back right side. Therefore, the lead-out conductor 34 does not have the substantially spiral shape when viewed from above.

The lead-out conductor 36*a* is disposed within the via hole H3. The lead-out conductor 36*a* is a conductor having a substantially rectangular shape and penetrating the insulator layer 18*b* through the via hole H3 in the up-down direction to be connected to an inner end portion of the coil conductor layer 25.

The lead-out conductor 36*b* is disposed on the front surface of the insulator layer 18*a* and within the via hole H2. A back-left end portion of the lead-out conductor 36*b* penetrates the insulator layer 18*a* through the via hole H2 in the up-down direction to be connected to the lead-out conductor 36*a*. Moreover, the lead-out conductor 36*b* extends on the front surface of the insulator layer 18*a* toward the front right side from the via hole H2 to be led out to the corner C4 of the insulator layer 18*a* on the front right side. Accordingly, the lead-out conductor 36*b* does not have the substantially spiral shape when viewed from above.

The relay conductor 26 (one example of a first relay conductor) is electrically connected to the coil L2 and is disposed in the cut-away portion c6 (i.e., at the corner C3). In more detail, the relay conductor 26 has the shape of a substantially isosceles right triangle, which is identical to the shape of the cut-away portion c6 when viewed from above, and includes relay conductor layers 26*a* and 26*b*. The relay conductor layers 26*a* and 26*b* are connected in the mentioned order from the upper side to the lower side, and they have the same shape when viewed from above.

The relay conductor layer 26*a* is a conductor layer disposed in the cut-away portion c6, having the shape of a substantially isosceles right triangle, and extending from the front surface of the insulator layer 18*b* to the front surface of the insulator layer 18*c* in the up-down direction. However, the relay conductor layer 26*a* projects upward from the front surface of the insulator layer 18*b* by a distance corresponding to one layer. The relay conductor layer 26*b* is a conductor layer disposed on the front surface of the insulator layer 18*c* and having the shape of a substantially isosceles right triangle. However, the relay conductor layer 26*b* is not positioned in the cut-away portion cc that is formed in the insulator layer 18*c*. The relay conductor layer 26*b* projects upward from the front surface of the insulator layer 18*c* by a distance corresponding to one layer. Furthermore, the relay conductor layer 26*b* is connected to a back end portion of the lead-out conductor 34 to provide a substantially square shape, when viewed from above, in combination with the back end portion of the lead-out conductor 34. Thus, the relay conductor 26 is electrically connected to the outer end portion of the coil conductor layer 25.

The relay conductor 27 (one example of a second relay conductor) is electrically connected to the coil L2 and is disposed in the cut-away portions c3 and c4 (i.e., at the corner C4). In more detail, the relay conductor 27 has the shape of a substantially isosceles right triangle when viewed from above, which is identical to the shape of each of the cut-away portions c3 and c4, and includes relay conductor layers 27*a* to 27*c*. The relay conductor layers 27*a* to 27*c* are connected in the mentioned order from the upper side to the lower side, and they have the same shape when viewed from above.

The relay conductor layer 27*a* is a conductor layer disposed in the cut-away portion c3, having the shape of a substantially isosceles right triangle, and extending from the front surface of the insulator layer 18*a* to the front surface of the insulator layer 18*b* in the up-down direction. However, the relay conductor layer 27*a* projects upward from the front surface of the insulator layer 18*a* by a distance corresponding to one layer. Furthermore, the relay conductor layer 27*a* is connected to a front-right end portion of the lead-out conductor 36*b* to provide a substantially square shape, when viewed from above, in combination with the front-right end portion of the lead-out conductor 36*b*. Thus, the relay conductor 27 is electrically connected to the inner end portion of the coil conductor layer 25. The relay conductor layer 27*b* is a conductor layer disposed in the cut-away portion c4, having the shape of a substantially isosceles right triangle, and extending from the front surface of the insulator layer 18*b* to the front surface of the insulator layer 18*c* in the up-down direction. The relay conductor layer 27*c* is a conductor layer disposed on the front surface of the insulator layer 18*c* and having the shape of a substantially isosceles right triangle. However, the relay conductor layer 27*c* is not positioned in the cut-away portion cd that is formed in the insulator layer 18*c*.

The coils L1 and L2 and the relay conductors 21, 22, 26 and 27 are each fabricated, for example, by forming an Ag film with sputtering. Alternatively, the coils L1 and L2 and the relay conductors 21, 22, 26 and 27 may be each fabricated by employing a material with high electrical conductivity, such as Cu or Au.

The cut-away portions Ca to Cd are described here. The magnetic substrate 12*a* has a shape with ridges of the magnetic substrate 12*a* overlapping the relay conductors 21, 22, 26 and 27 when viewed from above, are cut away as the cut-away portions Ca, Cb, Cc and Cd (each being one example of a second cut-away portion), respectively. Thus, the cut-away portions Ca to Cd are spaces corresponding to differences between a substantially rectangular parallelepiped and the magnetic substrate 12*a*. The cut-away portion Ca is a space formed by cutting away the ridge of the magnetic substrate 12*a* on the back left side. The cut-away portion Cb is a space formed by cutting away the ridge of the magnetic substrate 12*a* on the front left side. The cut-away portion Cc is a space formed by cutting away the ridge of the magnetic substrate 12*a* on the back right side. The cut-away portion Cd is a space formed by cutting away the ridge of the magnetic substrate 12*a* on the front right side. The following description is made in connection with the cut-away portion Cc, by way of example. Because the cut-away portions Ca, Cb, Cd, ca, cb and cd are the same as the cut-away portions Cc and cc, respectively, description of the formers is omitted.

As illustrated in FIG. 3B, ridges and thereabout of the magnetic substrate 12*a*, the ridges extending in the up-down direction, are each cut away in the form of a substantially hanging bell (or dome) that is in a state standing upward convexly from the principal surface S2 toward the principal surface S1. Therefore, an area of the cut-away portion Cc when viewed from above gradually decreases from the principal surface S2 toward the principal surface S1 (i.e., toward the upper side). The cut-away portion Cc has a substantially sector shape with a center angle of about 90° when viewed from above. Furthermore, as illustrated in FIG. 3B, a peripheral surface defining the cut-away portion Cc forms an obtuse angle θ relative to the principal surface S2. The connecting portion 16*c* covers the peripheral surface of the cut-away portion Cc, and it does not fill the cut-away portion Cc. Accordingly, in FIG. 3B, hatching is not drawn in a region within the cut-away portion Cc to represent the absence of the connecting portion 16*c* therein. The connecting portion 16*c* appears on the side behind a cross-section illustrated in FIG. 3B, and a lead-out line is attached to a portion where hatching is not drawn.

Moreover, as illustrated in FIG. 3B, the cut-away portion Cc reaches the multilayer body 14 through the cut-away corner C3 of the insulator layer 18*c*. Thus, the cut-away portion cc having a substantially sector shape with a center angle of about 90° is formed at the corner C3 of the insulator layer 18*c*. In other words, the cut-away portion cc is a region corresponding to a difference between the substantially rectangular upper surface of the electronic component 10 and the insulator layer 18*c* when viewed from above. Since the cut-away portion Cc reaches the multilayer body 14 as described above, the relay conductor layer 26*b* is exposed to the cut-away portion Cc and partly constitutes the peripheral surface of the cut-away portion Cc, as illustrated in FIG. 3B.

As illustrated in FIG. 3C, the cut-away portion cc is located within the relay conductor layer 26*b* when viewed from above. In other words, as illustrated in FIG. 3C, the relay conductor layer 26*b* protrudes out from the cut-away portion cc when viewed from above. Accordingly, as illustrated in FIG. 3B, the insulator layer 18*c* (one example of a second insulator layer) is contacted with the relay conductor layer 26*b* from below in a portion of the relay conductor layer 26*b*, the portion protruding from the cut-away portion cc (i.e., in a region denoted by Y in FIG. 3B). Thus, the insulator layer 18*c* is contacted with a lower surface of the portion of the relay conductor layer 26*b* protruding from the cut-away portion cc. Hence the relay conductor layer 26*b* is not contacted with the magnetic substrate 12*a*. It is to be noted that the relay conductor layer 26*b* may be partly contacted with the magnetic substrate 12*a*, but the relay conductor layer 26*b* is preferably not contacted with the magnetic substrate 12*a* at all. Though not described in detail here, the insulator layer 18*c* is further contacted with lower surfaces of portions of the relay conductor layers 21*b*, 22*c* and 27*c*, those portions protruding from the cut-away portion ca, cb and cd, respectively.

The outer electrodes 15*a* to 15*d* (the outer electrode 15*c* being one example of a first outer electrode, the outer electrode 15*d* being one example of a second outer electrode, and the outer electrode 15*a* being one example of a third outer electrode) are disposed on the front surface of the magnetic substrate 12*a* and are electrically connected to the relay conductors 21, 22, 26 and 27, respectively. In this embodiment, the outer electrodes 15*a* to 15*d* are connected to respective lower ends of the relay conductors 21, 22, 26 and 27. The outer electrodes 15*a* to 15*d* include connecting portion 16*a* to 16*d* and bottom portions 17*a* to 17*d*, respectively.

The bottom portion 17*a* is a conductor layer having a substantially rectangular shape and disposed near a corner of the principal surface S2 on the back left side. The connecting portion 16*a* is disposed to cover a peripheral surface of the cut-away portion Ca for connection to the relay conductor 21 and the bottom portion 17*a*. The bottom portion 17*b* is a conductor layer having a substantially rectangular shape and disposed near a corner of the principal surface S2 on the front left side. The connecting portion 16*b* is disposed to cover a peripheral surface of the cut-away portion Cb for connection to the relay conductor 22 and the bottom portion 17*b*. The bottom portion 17*c* is a conductor layer having a substantially rectangular shape and disposed near a corner of the principal surface S2 on the back right side. The connecting portion 16*c* is disposed to cover a peripheral surface of the cut-away portion Cc for connection to the relay conductor 26 and the bottom portion 17*c*. The bottom portion 17*d* is a conductor layer having a substantially rectangular shape and disposed near a corner of the principal surface S2 on the front right side. The connecting portion 16*d* is disposed to cover a peripheral surface of the cut-away portion Cd for connection to the relay conductor 27 and the bottom portion 17*d*.

Positional relations among the coil conductor layer 25, the relay conductors 21, 22, 26 and 27, and the connecting portions 16*a* to 16*d* will be described below with reference to the drawings.

As illustrated in FIGS. 3A and 3D, a shortest distance D1 between the coil conductor layer 25 and the connecting portion 16*d* is longer than a shortest distance D2 between the coil conductor layer 25 and the relay conductor 27. Furthermore, though not illustrated, a shortest distance D1 between the coil conductor layer 25 and the connecting portion 16*a* is longer than a shortest distance D2 between the coil conductor layer 25 and the relay conductor 21. A shortest distance D1 between the coil conductor layer 25 and the connecting portion 16*b* is longer than a shortest distance D2 between the coil conductor layer 25 and the relay conductor 22. Similarly, the shortest distance D1 between the coil conductor layer 25 and the connecting portion 16*c* is longer than the shortest distance D2 between the coil conductor layer 25 and the relay conductors 26.

As seen from FIG. 3B, the connecting portions 16*a* to 16*d* (the connecting portions 16*a*, 16*b* and 16*d* being not illustrated) are not overlapped with the coil conductor layers 20 and 25 when viewed from above.

The bottom portions 17*a* to 17*d* are each fabricated by forming an Au film, a Ni film, a Cu film, and a Ti film in a laminated state with sputtering. Alternatively, the bottom portions 17*a* to 17*d* may be each fabricated by applying and firing a paste that contains a metal such as Ag or Cu, or by forming a film of, e.g., Ag or Cu with vapor deposition or plating. The connecting portions 16*a* to 16*d* are each fabricated by forming a conductor film, which contains Cu as a main ingredient, with plating. Alternatively, the connecting portions 16*a* to 16*d* may be each fabricated by employing a material with high electrical conductivity, such as Ag or Au.

An operation of the electronic component 10 having the above configuration will be described below. The outer electrodes 15*a* and 15*c* are used, for example, as input terminals. The outer electrodes 15*b* and 15*d* are used, for example, as output terminals.

Differential transmission signals made up of a first signal and a second signal, which have a phase difference of about 180° therebetween, are input respectively to the outer electrodes 15*a* and 15*c*. Because the first signal and the second signal are in a differential mode, they generate magnetic fluxes in the coils L1 and L2, respectively, in opposite directions when passing through the coils L1 and L2. The magnetic flux generated in the coil L1 and the magnetic flux generated in the coil L2 cancel each other. Therefore, an increase or a decrease in the magnetic flux caused by the first signal and the second signal flowing through the coils does not substantially occur in the coils L1 and L2. In other words, the coils L1 and L2 generate no counter-electromotive force that impedes the flowing of the first signal and the second signal. As a result, the electronic component 10 exhibits just very low impedance for the first signal and the second signal.

On the other hand, when common mode noise is contained in the first signal and the second signal, the common mode noise generates magnetic fluxes in the same direction in the coils L1 and L2 when passing through the coils L1 and L2. In the coils L1 and L2, therefore, the common mode noise flows and the magnetic fluxes increase. Thus, the coils L1 and L2 generate counter-electromotive forces that impede the flowing of the common mode noise. As a result, the electronic component 10 exhibits high impedance for the common mode noise.

(Manufacturing Method for Electronic Component)

A manufacturing method for the electronic component 10 will be described below with reference to the drawings. FIGS. 4A to 7D are each a sectional view illustrating a step in manufacturing of the electronic component 10. FIG. 8 is a sectional view illustrating a step of forming a through-hole.

Figure 4A:
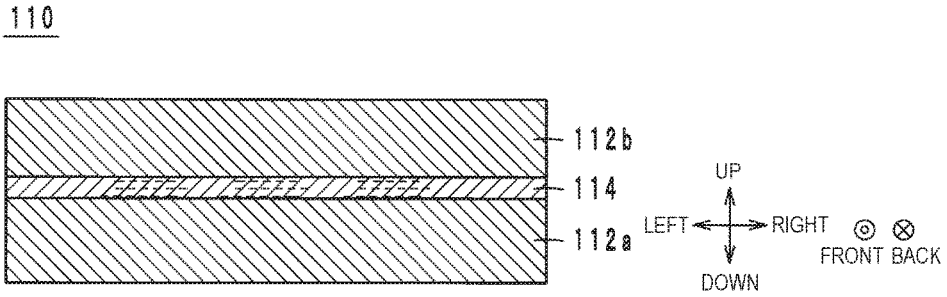
FIG. 4A is a sectional view illustrating a step in manufacturing of the electronic component.

First, a mother body 110 is prepared in which a mother multilayer body 114 (see FIG. 4A) is sandwiched between a mother substrate 112*a* (see FIG. 4A, one example of a first mother substrate) and a mother substrate 112*b* (see FIG. 4A). The mother substrates 112*a* and 112*b* are each a large-sized substrate including the plurality of magnetic substrates 12*a* and 12*b* arrayed in a matrix pattern in both the front-back direction and the left-right direction. The mother multilayer body 114 is a large-sized multilayer body including the plurality of the multilayer bodies 14 arrayed in a matrix pattern in both the front-back direction and the left-right direction.

More specifically, a photosensitive resin, e.g., a polyimide resin, is coated over an entire principal surface S1 of the mother substrate 112*a*, which has been fired, to form a resin layer in a state not yet solidified. Then, the not-yet-solidified resin layer is exposed and heated. As a result, the not-yet-solidified resin is solidified, and the insulator layer 18*c* is formed on the principal surface S1.

Next, an Ag film is formed on the insulator layer 18*c* by sputtering. A photoresist is then formed on regions of the Ag film where the coil conductor layer 25, the relay conductor layers 21*b*, 22*c*, 26*b* and 27*c* (each being one example of a first relay conductor layer that becomes a part of the relay conductor), and the lead-out conductor 34 are to be formed. The Ag film is then removed by etching from a region except for the regions where the coil conductor layer 25, the relay conductor layers 21*b*, 22*c*, 26*b* and 27*c*, and the lead-out conductor 34 are to be formed (i.e., except for the regions covered with the photoresist). Thereafter, the photoresist is removed with an organic solvent. As a result, the coil conductor layer 25, the relay conductor layers 21*b*, 22*c*, 26*b* and 27*c*, and the lead-out conductor 34 are formed on the insulator layer 18*c*.

Next, a photosensitive resin, e.g., a polyimide resin, is coated over the entire surface of the insulator layer 18*c* to form a resin layer in a state not yet solidified. The not-yet-solidified resin layer is then exposed in a state blocked off against light at positions corresponding to the cut-away portions c2 and c4 to c6 and the via hole H3 of the insulator layer 18*b*. With the exposure, the not-yet-solidified resin layer in a region having not been blocked off against light is solidified. After removing the photoresist with an organic solvent, the not-yet-solidified resin layer is subjected to development and is removed. The remaining resin layer is heated to be thermally-solidified. As a result, the insulator layer 18*b* is formed.

Next, an Ag film is formed on the insulator layer 18*b* by sputtering. A photoresist is then formed on regions of the Ag film where the coil conductor layer 20, the relay conductor layers 21*a*, 22*b*, 26*a* and 27*b*, and the lead-out conductors 30 and 36*a* are to be formed. The Ag film is then removed by etching from a region except for the regions where the coil conductor layer 20, the relay conductor layers 21*a*, 22*b*, 26*a* and 27*b*, and the lead-out conductors 30 and 36*a* are to be formed (i.e., except for the regions covered with the photoresist). Thereafter, the photoresist is removed with an organic solvent. As a result, the coil conductor layer 20, the relay conductor layers 21*a*, 22*b*, 26*a* and 27*b*, and the lead-out conductors 30 and 36*a* are formed.

Next, a photosensitive resin, e.g., a polyimide resin, is coated over the entire surface of the insulator layer 18*b* to form a resin layer in a state not yet solidified. The not-yet-solidified resin layer is then exposed in a state blocked off against light at positions corresponding to the cut-away portions c1 and c3 and the via holes H1 and H2 of the insulator layer 18*a*. With the exposure, the not-yet-solidified resin layer in a region having not been blocked off against light is solidified. After removing the photoresist with an organic solvent, the not-yet-solidified resin layer is subjected to development and is removed. The remaining resin layer is heated to be thermally-solidified. As a result, the insulator layer 18*a* is formed.

Next, an Ag film is formed on the insulator layer 18*a* by sputtering. A photoresist is then formed on regions of the Ag film where the relay conductor layers 22*a* and 27*a* and the lead-out conductors 32 and 36*b* are to be formed. The Ag film is then removed by etching from a region except for the regions where the relay conductor layers 22*a* and 27*a* and the lead-out conductors 32 and 36*b* are to be formed (i.e., except for the regions covered with the photoresist). Thereafter, the photoresist is removed with an organic solvent. As a result, the relay conductor layers 22*a* and 27*a* and the lead-out conductors 32 and 36*b* are formed. The mother multilayer body 114 is completed through the above-mentioned steps.

Next, the mother substrate 112*b* is bonded onto the mother multilayer body 114 with the organic adhesive layer 19 interposed therebetween. As a result, the mother body 110 illustrated in FIG. 4A is obtained.

Figure 4B:
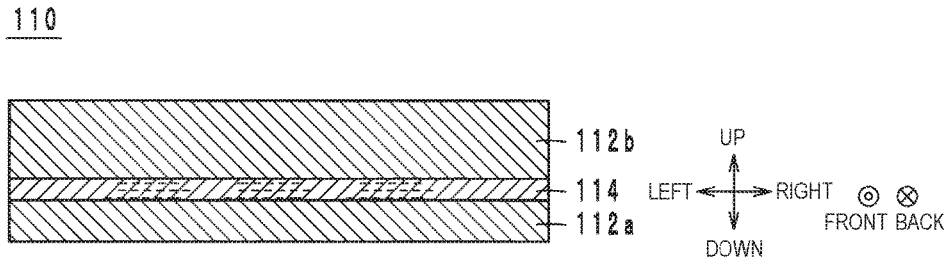
FIG. 4B is a sectional view illustrating a step in manufacturing of the electronic component.

Next, as illustrated in FIG. 4B, a lower principal surface of the mother substrate 112*a* is ground or polished.

Figure 4C:
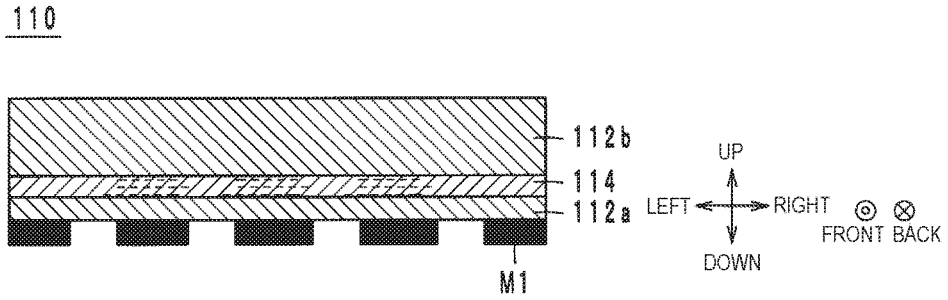
FIG. 4C is a sectional view illustrating a step in manufacturing of the electronic component.

Next, as illustrated in FIG. 4C, while making alignment with respect to the coils L1 and L2 inside the mother multilayer body 114, a photoresist M1 is formed on the lower principal surface of the mother substrate 112*a*. The photoresist M1 has openings in regions where the cut-away portions Ca to Cd are to be formed.

Figure 5A:
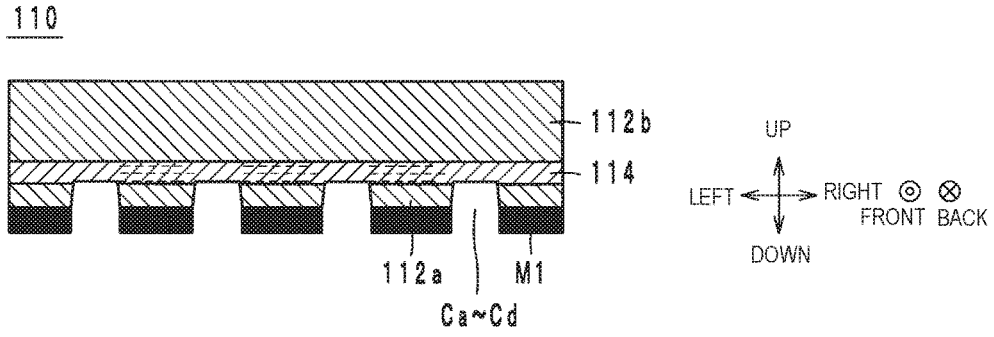
FIG. 5A is a sectional view illustrating a step in manufacturing of the electronic component.

Next, as illustrated in FIG. 5A, through-holes are formed in the mother substrate 112*a* by sandblasting in a state penetrating the photoresist M1 as well as at positions where the cut-away portions Ca to Cd are to be formed (one example of a third step). As illustrated in FIG. 8, the through-holes penetrate respective portions of the mother substrate 112*a* and the insulator layer 18*c*, those portions overlapping the relay conductor layers 21*b*, 22*c*, 26*b* and 27*c* when viewed from above. Thus, the lower surfaces of the relay conductor layers 21*b*, 22*c*, 26*b* and 27*c*, which are positioned on the lowermost side in the relay conductors 21, 22, 26 and 27, are partly exposed to the through-holes (i.e., the cut-away portions Ca to Cd), respectively. The through-holes may be formed by laser processing instead of by sandblasting. As an alternative, the through-holes may be formed by a combination of laser processing and sandblasting.

Figure 5B:
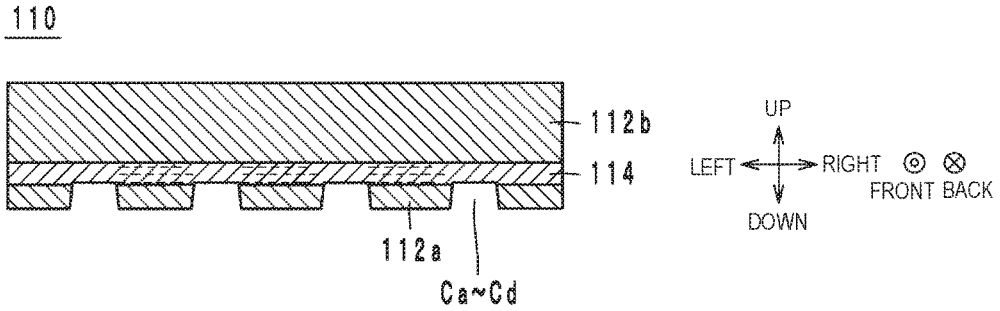
FIG. 5B is a sectional view illustrating a step in manufacturing of the electronic component.

Next, as illustrated in FIG. 5B, the photoresist M1 is removed with an organic solvent.

Figure 5C:
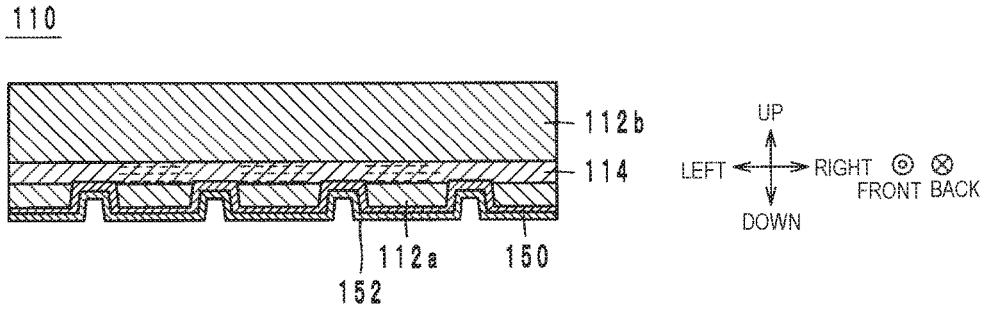
FIG. 5C is a sectional view illustrating a step in manufacturing of the electronic component.

Next, as illustrated in FIG. 5C, a Ti thin film 150 and a Cu thin film 152 are successively formed over an entire lower principal surface of the mother body 110 in the mentioned order by sputtering.

Figure 6A:
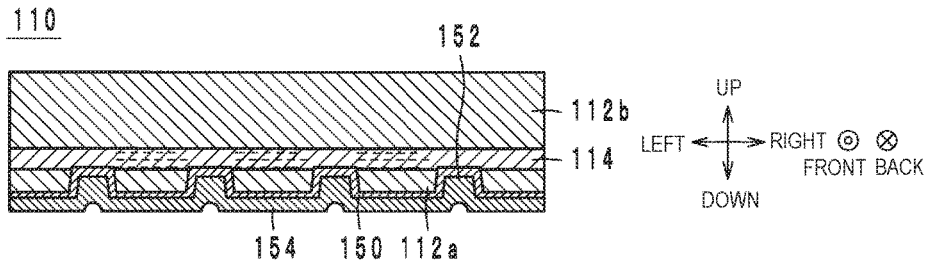
FIG. 6A is a sectional view illustrating a step in manufacturing of the electronic component.

Next, as illustrated in FIG. 6A, a Cu plating film 154 is formed by electrolytic plating with the Ti thin film 150 and the Cu thin film 152 being used as power feed films.

Figure 6B:
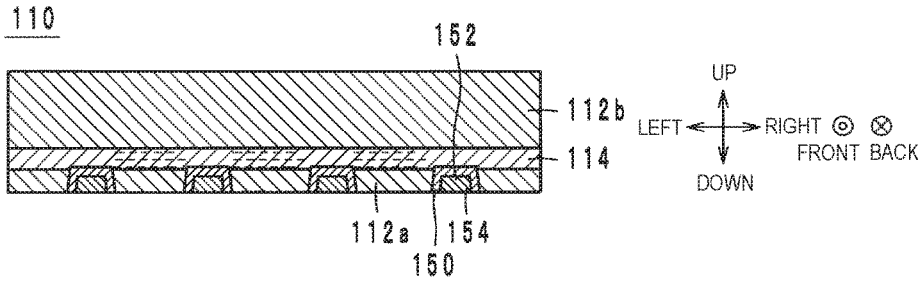
FIG. 6B is a sectional view illustrating a step in manufacturing of the electronic component.

Next, as illustrated in FIG. 6B, the Ti thin film 150, the Cu thin film 152, and the Cu plating film 154 formed in a region except for the through-holes are removed by, e.g., wet etching, grinding, polishing, or CMP. As a result, the lower principal surface of the mother body 110 is planarized. Through the steps illustrated in FIGS. 5C to 6B, conductor layers are formed over peripheral surfaces of the through-holes, whereby the connecting portions 16*a* to 16*d* (i.e., parts of the outer electrodes 15*a* to 15*d*) are formed (one example of a fourth step).

Figure 6C:
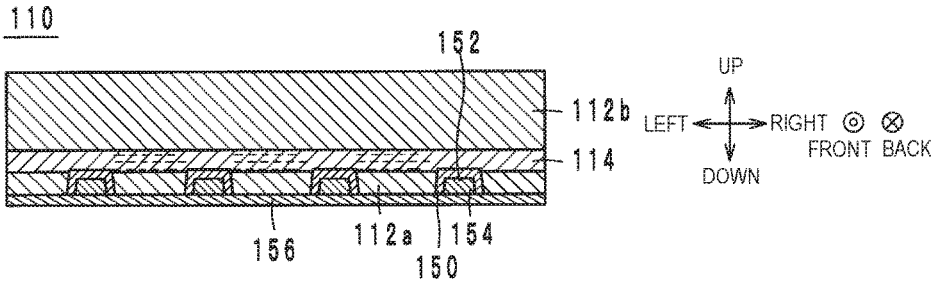
FIG. 6C is a sectional view illustrating a step in manufacturing of the electronic component.

Next, as illustrated in FIG. 6C, a conductor layer 156 made up of a Ti film, a Cu film, a Ni film, and an Au film, which are successively laminated in the mentioned order from the lower layer side toward the upper layer side, is formed over the entire lower principal surface of the mother body 110 by sputtering.

Figure 6D:
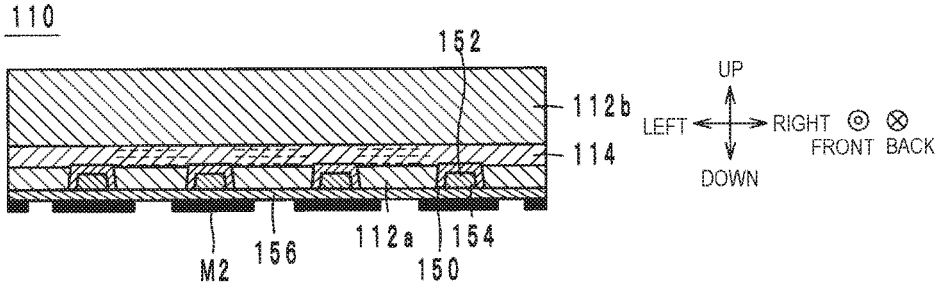
FIG. 6D is a sectional view illustrating a step in manufacturing of the electronic component.

Next, as illustrated in FIG. 6D, a photoresist M2 is formed over the lower principal surface of the mother body 110. The photoresist M2 covers regions where the bottom portions 17*a* to 17*d* are to be formed.

Figure 7A:
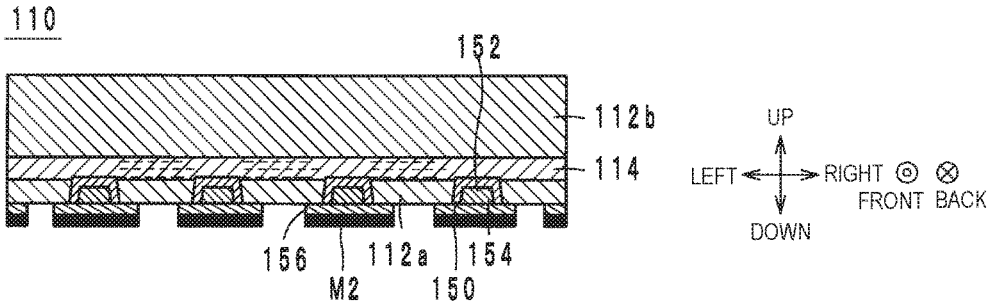
FIG. 7A is a sectional view illustrating a step in manufacturing of the electronic component.
Figure 7B:
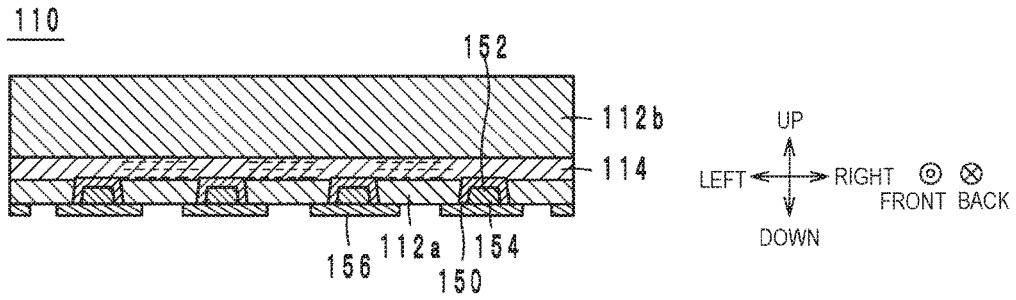
FIG. 7B is a sectional view illustrating a step in manufacturing of the electronic component.
Figure 8:
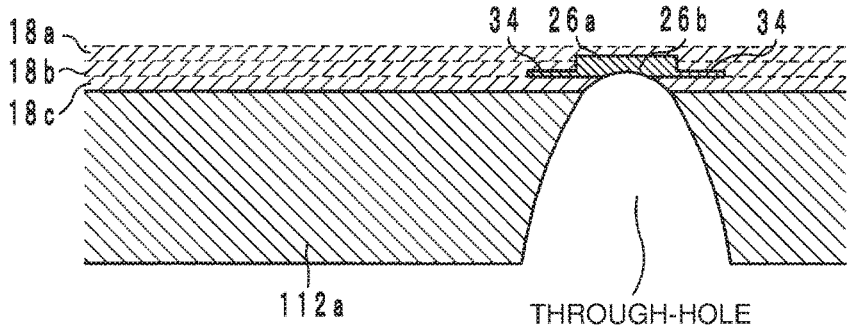
FIG. 8 is a sectional view illustrating a step of forming a through-hole.

Next, as illustrated in FIG. 7A, the conductor layer 156 is removed by etching from a region except for the regions covered with the photoresist M2. Then, as illustrated in FIG. 7B, the photoresist M2 is removed with an organic solvent. As a result, the bottom portions 17*a* to 17*d* (i.e., parts of the outer electrodes 15*a* to 15*d*) are formed.

Figure 7C:
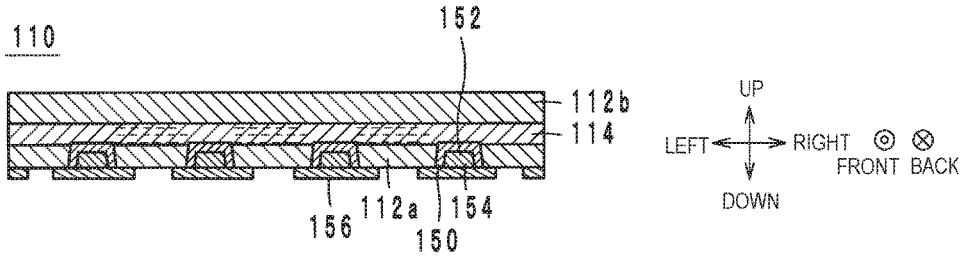
FIG. 7C is a sectional view illustrating a step in manufacturing of the electronic component.

Next, as illustrated in FIG. 7C, an upper principal surface of the mother substrate 112*b* is ground or polished.

Figure 7D:
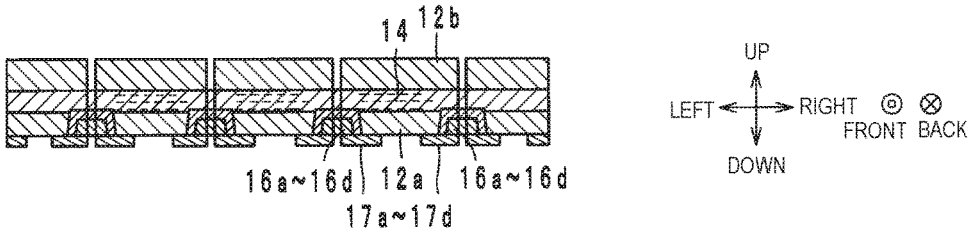
FIG. 7D is a sectional view illustrating a step in manufacturing of the electronic component.

Next, as illustrated in FIG. 7D, the mother body 110 (including the mother substrate 112*a*) is cut with a dicer, whereby the plurality of electronic components 10 are obtained (one example of a fifth step). In the step of FIG. 7D, the dicer is operated to pass through the Ti thin film 150, the Cu thin film 152, and the Cu plating film 154, which are positioned inside the through-holes. As a result, the Ti thin film 150, the Cu thin film 152, and the Cu plating film 154 are divided into the connecting portions 16*a* to 16*d*. Thereafter, the electronic components 10 may be chamfered by barrel polishing. After the barrel polishing, Ni plating and Sn plating may be carried out on surfaces of the outer electrodes 15*a* to 15*d* for the purpose of improving solder wettability.

(Advantageous Effects)

With the electronic component 10 according to this embodiment, the relay conductors 21, 22, 26 and 27 disposed in the multilayer body 14 on the magnetic substrate 12*a* can be suppressed from slipping off from the multilayer body 14. That point will be described below with reference to FIG. 3B, taking the relay conductor 26 as an example.

Figure 10A:
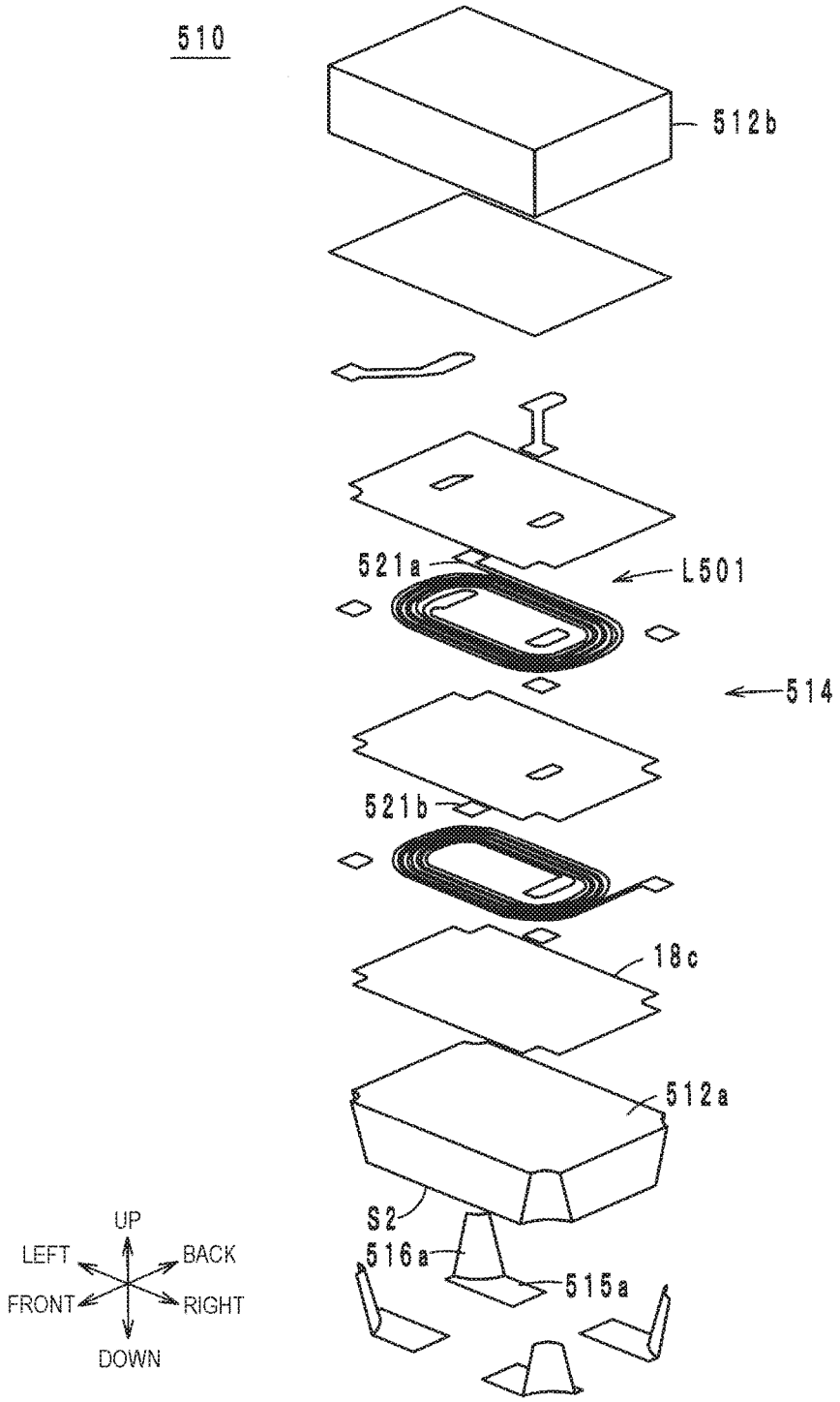
FIG. 10A is an external perspective view of an electronic component disclosed in International Publication No. 2013/031880.
Figure 10B:
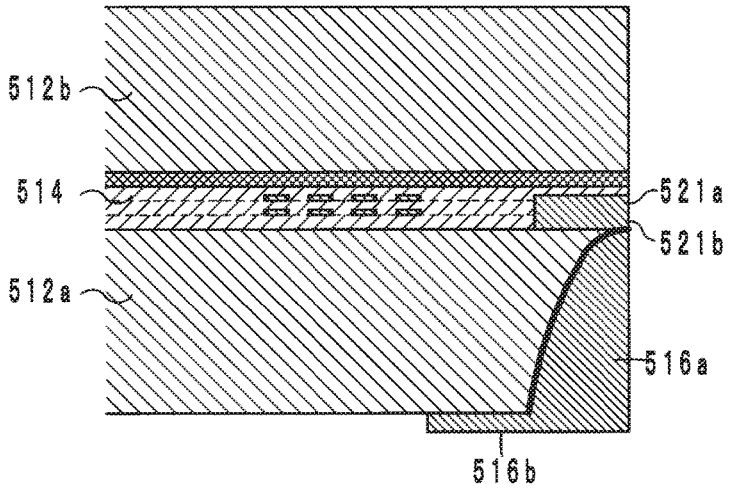
FIG. 10B is a sectional structural view of a part of the electronic component illustrated in FIG. 10A, the part including lead-out portions and the vicinity thereof.

In the electronic component 510 of related art, the lead-out portions 521*a* and 521*b* tend to slip off from the multilayer body 514 for the following reason. In more detail, as illustrated in FIG. 10B, the lead-out portion 521*b* is directly formed on the upper surface of the magnetic substrate 512*a*. The magnetic substrate 512*a* is comparatively hard. Therefore, adhesivity of the lead-out portion 521*b* with respect to the magnetic substrate 512*a* is comparatively low. Accordingly, when impacts are applied to the electronic component 510, peeling-off may occur between the lead-out portion 521*b* and the magnetic substrate 512*a*, and the lead-out portions 521*a* and 521*b* may slip off from the multilayer body 514.

In contrast, the electronic component 10 has the structure described below. The insulator layer 18*b* has a shape that the corner C3 is cut away with the presence of the cut-away portion c6. The relay conductor 26 is disposed in the cut-away portion c6 of the insulator layer 18*b*. Furthermore, the insulator layer 18*c* is contacted with the relay conductor layer 26*b* from below. With that structure, the lower end of the relay conductor 26 is contacted with the insulator layer 18*c*. A material of the insulator layer 18*c* is resin. Therefore, the insulator layer 18*c* is softer than the magnetic substrate 12*a* or 512*a*. Hence adhesivity of the relay conductor 26 with respect to the insulator layer 18*c* is higher than that of the lead-out portion 521*b* with respect to the magnetic substrate 512*a*. Moreover, because the insulator layer 18*c* is soft, it is deformable corresponding to deformation of the relay conductor 26 caused by expansion or contraction due to heat, or by impacts applied from the outside. Accordingly, peeling-off between the relay conductor 26 and the insulator layer 18*c* is less likely to occur in comparison with peeling-off between the lead-out portion 521*b* and the magnetic substrate 512*a*. As a result, in the electronic component 10, the relay conductor 26 is suppressed from slipping off from the multilayer body 14.

Moreover, in the electronic component 10, the occurrence of disconnection between the coil L1 or L2 and the relay conductors 21 and 22 or 26 and 27 is suppressed. That point will be described below, taking the disconnection between the coil L2 and the relay conductor 26 as an example.

When mounting the electronic component 510 to a circuit board, a land electrode on the circuit board and the outer electrode 515*a* are fixedly connected with a solder. At that time, stress is applied to the outer electrode 515*a* from the solder. Such stress causes peeling-off between the lead-out portion 521*b* and the magnetic substrate 512*a*. If the peeling-off occurs between the lead-out portion 521*b* and the magnetic substrate 512*a*, the lead-out portions 521*a* and 521*b* are displaced relative to the multilayer body 514, thus resulting in a possibility that disconnection may occur between the coil L1 and the lead-out portions 521*a* and 521*b*.

To cope with the above problem, the electronic component 10 is constituted, as described above, such that the insulator layer 18*c* is contacted with the relay conductor 26 from below. The adhesivity of the relay conductor 26 with respect to the insulator layer 18*c* is comparatively high. Therefore, the peeling-off between the relay conductor 26 and the insulator layer 18*c* is less likely to occur. As a result, it is possible to suppress an accident that the relay conductor is displaced in the multilayer body 14, and that disconnection occurs between the relay conductor 26 and the coil L2.

Here, as illustrated in FIG. 3C, an area of the relay conductor layer 26*b* when viewed from above is assumed to be an area A1. An area of a region where the relay conductor layer 26*b* and the insulator layer 18*c* contact each other when viewed from above is assumed to be an area A2. In FIG. 3C, the areas A1 and A2 are each illustrated as an area surrounded by a one-dot-chain line. Note that, in FIG. 3C, the one-dot-chain lines are drawn at positions slightly deviated from an outer edge of the relay conductor 26 and an outer edge of the cut-away portion cc for making the surrounded regions easily understandable. A value X of the ratio of the area A1 to the area A2 is preferably not less than about 0.42 and not more than about 0.82. With the value X of the ratio of the area A1 to the area A2 falling within the above-mentioned range, the relay conductor layer 26*b* and the insulator layer 18*c* are firmly joined to each other with high adhesivity. The reason why the above range of the value X is preferable will be described below.

First, the inventors actually fabricated the plurality of electronic components 10 as experimental examples. In the experimental examples, the value X was set to fall within a certain range by changing the area A1 of the relay conductor layer 26*b* and an area of the cut-away portion cc at various ratios. More specifically, in the experimental example where the value X was minimal, the area A1 was set to 0.00156 $mm^2$, and the area of the cut-away portion cc was set to 0.00090 $mm^2$. In that case, the area A2 of the region where the relay conductor layer 26*b* and the insulator layer 18*c* contact each other was 0.00066 $mm^2$, and the value X was about 0.42. In the experimental example where the value X was maximal, the area A1 was set to 0.00169 $mm^2$, and the area of the cut-away portion cc was set to 0.00030 $mm^2$. In that case, the area A2 of the region where the relay conductor layer 26*b* and the insulator layer 18*c* contact each other was 0.00139 $mm^2$, and the value X was about 0.82.

In the above experimental examples, slipping-off of the relay conductor 26 did not occur during a cutting step using a dicer and a scribing step in manufacturing. It is hence understood that when the value X is not less than about 0.42 and not more than about 0.82, slipping-off of the relay conductor 26 does not occur during the manufacturing, and that the above-mentioned range is the preferable range.

In the electronic component 10, however, the slipping-off of the relay conductor 26 can be suppressed insofar as the relay conductor 26 is held at least in a state contacting the insulator layer 18*c*, which has higher adhesivity than the magnetic substrate 12*a* as described above. Accordingly, the value X may be a value outside the range of not less than about 0.42 and not more than about 0.82. In particular, the value X may exceed an upper limit value of the above range. In the electronic component 10, the relay conductors 21, 22, and 27 are also suppressed from slipping off from the multilayer body 14 for the same reason as described above.

Furthermore, in the electronic component 10, the relay conductors 21 and 26 disposed in the multilayer body 14 on the magnetic substrate 12*a* can be suppressed from slipping off from the multilayer body 14 for the following reason. The reason will be described below with reference to FIG. 3B, taking the relay conductor 26 as an example.

In the electronic component 10, the insulator layer 18*a* (one example of a third insulator layer) is contacted with the relay conductor 26 from above. Thus, an upper end of the relay conductor 26 is also held in the multilayer body 14 by the insulator layer 18*a* having high adhesivity with respect to the relay conductor 26. As a result, in the electronic component 10, the relay conductor 26 is further suppressed from slipping off from the multilayer body 14. For the same reason, the relay conductor 21 is also further suppressed from slipping off from the multilayer body 14.

In addition, a common-mode choke coil having high impedance can be obtained with the electronic component 10. More specifically, in the electronic component 10, the magnetic substrate 12*a* has a shape that four ridges connecting the principal surfaces S1 and S2 to each other are cut away in the cut-away portions Ca to Cd. The connecting portions 16*a* to 16*d* connecting the bottom portions 17*a* to 17*d* and the relay conductors 21, 22, 26 and 27 are disposed in the cut-away portions Ca to Cd, respectively. Thus, the connecting portions 16*a* to 16*d* are disposed at positions farthest apart from the center of the magnetic substrate 12*a* when viewed from above. In other words, the connecting portions 16*a* to 16*d* are disposed in the magnetic substrate 12*a* at positions farthest apart from the coils L1 and L2 when viewed from above. As a result, magnetic fluxes generated from the coils L1 and L2 are suppressed from being impeded by the connecting portions 16*a* to 16*d*. Hence the common-mode choke coil having high impedance can be obtained with the electronic component 10.

Moreover, in the electronic component 10, the coil conductor layers 20 and 25 are not overlapped with the connecting portions 16*a* to 16*d* when viewed from above. With that feature, the connecting portions 16*a* to 16*d* are avoided from being positioned in magnetic paths of the magnetic fluxes generated by the coils L1 and L2. As a result, in the electronic component 10, inductance values of the coils L1 and L2 increase, and hence the impedance of the common-mode choke coil constituted by the coils L1 and L2 increases.

In the electronic component 10, as mentioned above, the coil conductor layers 20 and 25 are not overlapped with the connecting portions 16*a* to 16*d* when viewed from above. With that feature, the occurrence of capacitances between the coil conductor layers 20, 25 and the connecting portions 16*a* to 16*d* is suppressed. As a result, in the electronic component 10, an ability of removing noise in a high frequency range is improved.

In the electronic component 10, the multilayer body 14 incorporating the coils L1 and L2 is sandwiched between the magnetic substrates 12*a* and 12*b*. With that feature, the magnetic fluxes generated by the coils L1 and L2 pass through the magnetic substrates 12*a* and 12*b*. As a result, inductance values of the coils L1 and L2 increase, and hence the impedance of the common-mode choke coil constituted by the coils L1 and L2 increases.

In the electronic component 10, since the multilayer body 14 incorporating the coils L1 and L2 is sandwiched between the magnetic substrates 12*a* and 12*b*, inductance values of the coils L1 and L2 increase. Thus, even with each of the coil conductor layers 20 and 25 having a relatively small number of windings, the coils L1 and L2 can take sufficient inductance values. As a result, the sizes of the coil conductor layers 20 and 25 are reduced, and the size of the electronic component 10 is reduced.

In the electronic component 10, the inductance value of the coil L2 increases, and the impedance of the common-mode choke coil constituted by the coils L1 and L2 increases. That point will be described below in connection with the outer electrode 15*d* and the relay conductor 27, by way of example.

In the electronic component 10, a parasitic capacitance generated in the coil conductor layer 25 can be reduced as described below. The coil conductor layer 25 is opposed to the relay conductor layers 21*b*, 22*c* and 27*c* and the connecting portions 16*a* to 16*d*. Therefore, a parasitic capacitance generates between the coil conductor layer 25 and each of the relay conductor layers 21*b*, 22*c* and 27*c* and the connecting portions 16*a* to 16*d*. However, the electronic component 10 is usually designed such that the parasitic capacitance formed between the coil conductor layer 25 and each of the relay conductor layers 21*b*, 22*c* and 27*c* takes a value not causing problems. As illustrated in FIGS. 3A and 3D, by way of example, the shortest distance D1 between the coil conductor layer 25 and each of the connecting portions 16*a* to 16*d* is longer than the shortest distance D2 between the coil conductor layer 25 and each of the relay conductor layers 21*b*, 22*c*, 26*b* and 27*c*. With that feature, the parasitic capacitance formed between the coil conductor layer 25 and the connecting portion 16*c* also takes a value not causing problems. As a result, the parasitic capacitance generated in the coil conductor layer 25 can be reduced.

In the electronic component 10, the area of each of the cut-away portions Ca to Cd when viewed from above gradually decreases toward the principal surface S1 from the principal surface S2. Accordingly, the areas of the regions where the connecting portions 16*a* to 16*d* disposed in the cut-away portions Ca to Cd contact the relay conductors 21, 22, 26 and 27, respectively, are relatively small. Thus, the areas of the relay conductors 21, 22, 26 and 27 can be reduced. As a result, regions where the coil conductor layers 20 and 25 are to be formed can be increased, and the inductance values of the coils L1 and L2 can be increased without increasing the size of the electronic component 10. In addition, with the configuration described above, since the area of the region where the relay conductor 26 and the connecting portion 16*c* contact each other is relatively small, the area in which the relay conductor 26 and the insulator layer 18*c* contact each other can be increased without increasing the area of the relay conductor 26. As a result, the adhesivity between the relay conductor 26 and the insulator layer 18*c* can be further enhanced.

In the electronic component 10, as illustrated in FIG. 3B, each of the surfaces defining the cut-away portions Ca to Cd forms an obtuse angle θ relative to the principal surface S2. With that feature, each of the surfaces defining the cut-away portions Ca to Cd is formed to gradually depart away from the coil conductor layer 25. Therefore, the cut-away portions Ca to Cd (i.e., the connecting portions 16*a* to 16*d*) are suppressed from being positioned in the magnetic paths of the magnetic fluxes generated from the coil conductor layer 25. As a result, in the electronic component 10, the inductance value of the coil L2 increases, and hence the impedance of the common-mode choke coil constituted by the coils L1 and L2 increases.

Furthermore, since each of the surfaces defining the cut-away portions Ca to Cd forms the obtuse angle θ relative to the principal surface S2, discontinuity in shape is moderated. Accordingly, concentration of stress is moderated, the stress being generated attributable to a difference in thermal expansion coefficient between each of the magnetic substrate 12*a*, the bottom portions 17*a* to 17*d*, and the connecting portions 16*a* to 16*d* and a solder used for mounting.

(Modification of Electronic Component)

Figure 9A:
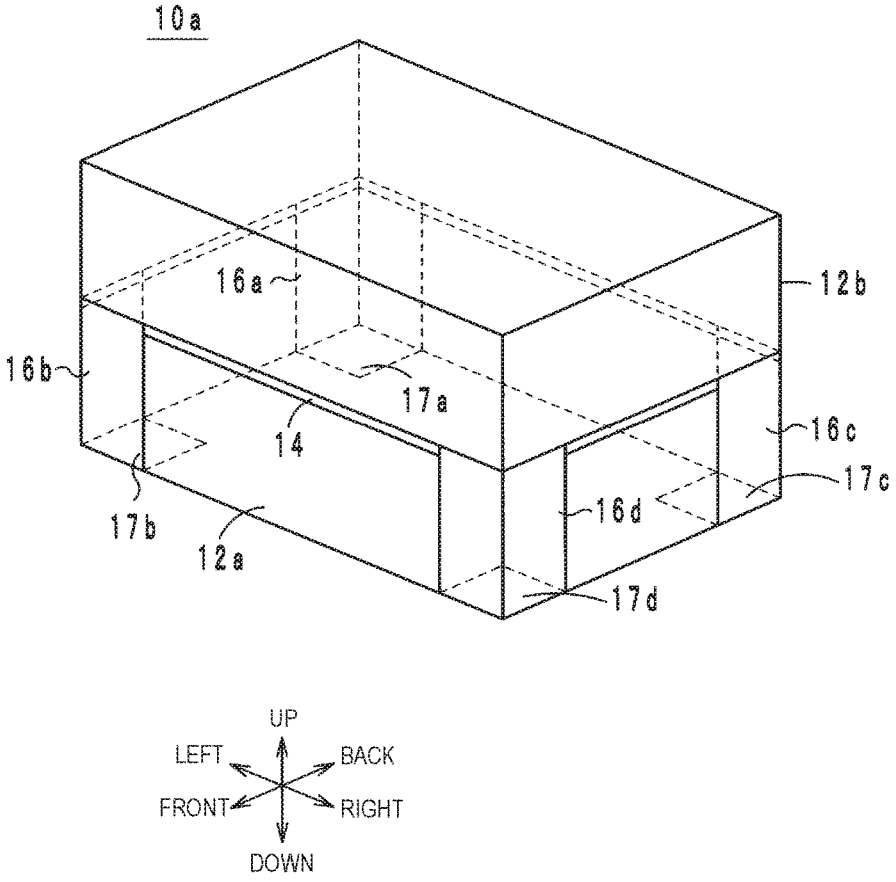
FIG. 9A is an external perspective view of an electronic component according to a modification.
Figure 9B:
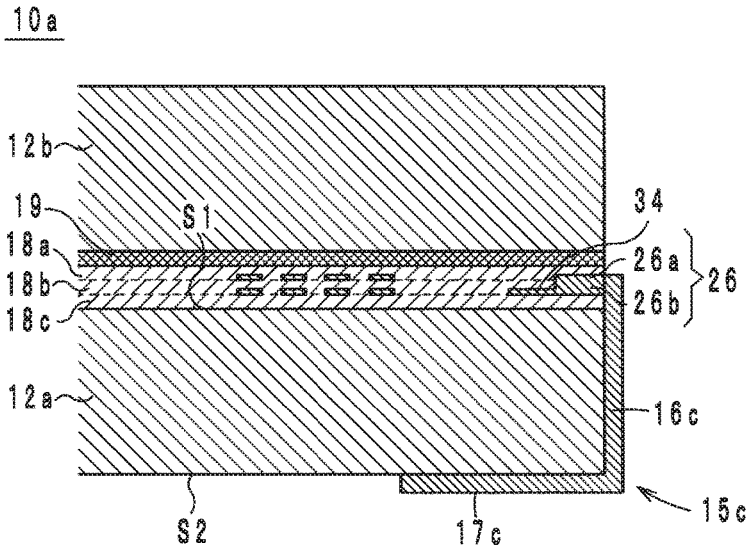
FIG. 9B is a sectional structural view of the electronic component according to the modification.

An electronic component 10*a* according to a modification will be described below with reference to the drawings. FIG. 9A is an external perspective view of the electronic component 10*a* according to the modification. FIG. 9B is a sectional structural view of the electronic component 10*a* according to the modification.

The electronic component 10*a* is different from the electronic component 10 in shapes of the outer electrodes 15*a* to 15*d*. The following description is made in connection with the outer electrode 15*c*, by way of example. Because the outer electrodes 15*a*, 15*b* and 15*d* have the same structure as that of the outer electrode 15*c*, description of the structures of the outer electrodes 15*a*, 15*b* and 15*d* is omitted.

The outer electrode 15*c* includes the connecting portion 16*c* and the bottom portion 17*c*. In the electronic component 10*a*, the cut-away portion Cc is not formed in the magnetic substrate 12*a*. The connecting portion 16*c* extends in the up-down direction so as to cover the ridge of the magnetic substrate 12*a* on the back right side. An upper end of the connecting portion 16*c* reaches the multilayer body 14, and it is connected to the relay conductor 26. The bottom portion 17*c* is disposed near the corner of the principal surface S2 on the back right side, and it has a substantially rectangular shape. The bottom portion 17*c* is connected to a lower end of the connecting portion 16*c*.

Thus, the outer electrode 15*c* is not always required to cover the peripheral surface of the cut-away portion Cc.

In the electronic component 10*a* having the above-described configuration, as in the electronic component 10, the relay conductors 21, 22, 26 and 27 disposed in the multilayer body 14 on the magnetic substrate 12*a* can be suppressed from slipping off from the multilayer body 14.

(Modification of Manufacturing Method for Electronic Component)

A modification of the manufacturing method for an electronic component 10*b* will be described below. While the insulator layers 18*a* to 18*c* in the electronic component 10 are each made of a material containing an insulating resin as a main ingredient, the insulator layers 18*a* to 18*c* in the electronic component 10*b* are each made of a material containing glass ceramic (one example of a material containing glass). In particular, the insulator layers 18*a* to 18*c* in the electronic component 10*b* are each made of a material containing glass ceramic as a main ingredient. For that reason, the manufacturing method for the electronic component 10*b* is different from the manufacturing method for the electronic component 10 in a step of forming the mother multilayer body 114. The following description of the manufacturing method for the electronic component 10*b* is made mainly about the above-mentioned different point (i.e., the step of forming the mother multilayer body 114).

Outline of the step of forming the mother multilayer body 114 is described prior to the detailed description. First, the mother multilayer body 114 in a green state not yet fired is formed on the principal surface S1 of the mother substrate 112*a* by alternately forming each of a plurality of paste layers, which are to become the insulator layers 18*a* to 18*c*, with use of the material containing glass ceramic, and corresponding ones of the coils L1 and L2 and the relay conductor layers 21*a*, 21*b*, 22*a* to 22*c*, 26*a*, 26*b* and 27*a* to 27*c* that are to become the relay conductors 21, 22, 26 and 27 (one example of a first step). Then, the green mother multilayer body 114 is fired (one example of a second step). The mother multilayer body 114 is formed through the above-mentioned two steps. The step of forming the mother multilayer body 114 will be described in more detail below.

First, a thermosetting glass paste is coated over the entire principal surface S1 of the mother substrate 112*a*, which has been fired, to form a paste layer (one example of a first paste layer) that is to become the insulator layer 18*c* (one example of the second insulating layer). Then, the paste layer, which is to become the insulator layer 18*c*, is heated for drying. Temperature during the drying is about 60° C. to 80° C., for example. Although the paste layer, which is to become the insulator layer 18*c*, is slightly solidified through the drying, it is still in a state not yet solidified.

Next, an Ag film is formed on the paste layer, which is to become the insulator layer 18*c*, by sputtering. A photoresist is then formed in regions of the Ag film where the coil conductor layer 25, the relay conductor layers 21*b*, 22*c*, 26*b* and 27*c* (one example of conductor layers that are to become parts of the relay conductors), and the lead-out conductor 34 are to be formed. The Ag film is then removed by etching from a region except for the regions where the coil conductor layer 25, the relay conductor layers 21*b*, 22*c*, 26*b* and 27*c*, and the lead-out conductor 34 are to be formed (i.e., except for the regions covered with the photoresist). Thereafter, the photoresist is removed with an organic solvent. As a result, the coil conductor layer 25, the relay conductor layers 21*b*, 22*c*, 26*b* and 27*c*, and the lead-out conductor 34 are formed on the paste layer that is to become the insulator layer 18*c*.

Next, a thermosetting glass paste is coated over the paste layer, which is to become the insulator layer 18*c*, by screen printing to form a paste layer that is to become the insulator layer 18*b*. Openings are formed in a screen plate for use in the screen printing except for regions corresponding to the cut-away portions c2 and c4 to c6 and the via hole H3. Therefore, the cut-away portions c2 and c4 to c6 and the via hole H3 are formed in the paste layer that is to become the insulator layer 18*b*. The paste layer, which is to become the insulator layer 18*b*, is then heated for drying. Temperature during the drying is about 60° C. to 80° C., for example. Although the paste layer, which is to become the insulator layer 18*b*, is slightly solidified through the drying, it is still in a state not yet solidified.

Next, an Ag film is formed on the paste layer, which is to become the insulator layer 18*b*, by sputtering. A photoresist is then formed in regions of the Ag film where the coil conductor layer 20, the relay conductor layers 21*a*, 22*b*, 26*a* and 27*b*, and the lead-out conductors 30 and 36*a* are to be formed. The Ag film is then removed by etching from a region except for the regions where the coil conductor layer 20, the relay conductor layers 21*a*, 22*b*, 26*a* and 27*b*, and the lead-out conductors 30 and 36*a* are to be formed (i.e., except for the regions covered with the photoresist). Thereafter, the photoresist is removed with an organic solvent. As a result, the coil conductor layer 20, the relay conductor layers 21*a*, 22*b*, 26*a* and 27*b*, and the lead-out conductors 30 and 36*a* are formed.

Next, a thermosetting glass paste is coated over the paste layer, which is to become the insulator layer 18*b*, by screen printing to form a paste layer that is to become the insulator layer 18*a*. Openings are formed in a screen plate for use in the screen printing except for regions corresponding to the cut-away portions c1 and c3 and the via holes H1 and H2. Therefore, the cut-away portions c1 and c3 and the via holes H1 and H2 are formed in the paste layer that is to become the insulator layer 18*a*. The paste layer, which is to become the insulator layer 18*a*, is then heated for drying. Temperature during the drying is about 60° C. to 80° C., for example. Although the paste layer, which is to become the insulator layer 18*a*, is slightly solidified through the drying, it is still in a state not yet solidified.

Next, an Ag film is formed on the insulator layer 18*a* by sputtering. A photoresist is then formed in regions of the Ag film where the relay conductor layers 22*a* and 27*a* and the lead-out conductors 32 and 36*b* are to be formed. The Ag film is then removed by etching from a region except for the regions where the relay conductor layers 22*a* and 27*a*, and the lead-out conductors 32 and 36*b* are to be formed (i.e., except for the regions covered with the photoresist). Thereafter, the photoresist is removed with an organic solvent. As a result, the relay conductor layers 22*a* and 27*a* and the lead-out conductors 32 and 36*b* are formed. The green mother multilayer body 114 is completed through the above-described steps.

Next, the green mother multilayer body 114 is fired. Temperature during the firing is higher than that during the drying, i.e., about 1000° C. As a result, the paste layers are solidified, and the fired mother multilayer body 114 is completed.

With the above electronic component 10*b* and the above manufacturing method for the electronic component 10*b*, the relay conductors 21, 22, 26 and 27 are suppressed from slipping off from the multilayer body 14. That point will be described below in connection with the relay conductor 26, by way of example.

The insulator layer 18*c* is made of a material containing glass. The insulator layer 18*c* made of the material containing glass is harder than the insulator layer 18*c* made of a material containing resin. Accordingly, if the relay conductor layer 26*b* is formed on the insulator layer 18*c* made of the material containing glass and having been fired, adhesivity between the relay conductor layer 26*b* and the insulator layer 18*c* made of the material containing glass is lower than that between the relay conductor layer 26*b* and the insulator layer 18*c* made of the material containing resin.

Meanwhile, when the insulator layers 18*a* to 18*c* are each made of the material containing glass, the step of firing the green mother multilayer body 114 is needed after forming the green mother multilayer body 114. In other words, the relay conductor layer 26*b* is not formed on the insulator layer 18*c* made of the material containing glass and having been fired. Thus, the relay conductor layer 26*b* and the paste layers are fired together. Therefore, the relay conductor layer 26*b* and the paste layer, which is to become the insulator layer 18*c*, are firmly joined to each other with high adhesivity. For that reason, with the electronic component 10*b* and the manufacturing method for the electronic component 10*b*, the relay conductor 26 is suppressed from slipping off from the multilayer body 14.

While the paste layers, which are to become the insulator layers 18*a* and 18*b*, are formed by screen printing in the above-described manufacturing method, they may be formed by photolithography in another example. The cut-away portions c1 to c6 and the via holes H1 to H3 may be formed, for example, by applying a laser beam.

(Other Embodiments)

The electronic component and the manufacturing method for the electronic component, according to the present disclosure, are not limited to the above-described electronic components 10, 10*a* and 10*b* and the manufacturing methods for those electronic components, and they can be modified within the gist of the present disclosure.

The features of the above-described electronic components 10, 10*a* and 10*b* and the manufacturing methods for those electronic components may be optionally combined with each other.

In the electronic components 10, 10*a* and 10*b*, it is just required that at least one of the connecting portions 16*a* to 16*d* is disposed.

In the manufacturing methods for the electronic components 10, 10*a* and 10*b*, the coil conductor layers 20 and 25, the lead-out conductors 30, 32, 34, 36*a* and 36*b*, and the relay conductor layers 21*a*, 21*b*, 22*a* to 22*c*, 26*a*, 26*b* and 27*a* to 27*c* may be formed by, e.g., screen printing, vapor deposition, or plating.

The magnetic substrates 12*a* and 12*b* are just required to be ceramic substrates having been fired. Thus, ceramic substrates made of nonmagnetic ferrite or ceramic substrates made of nonmagnetic alumina, for example, may be used instead of the magnetic substrates 12*a* and 12*b*.

At least one coil is just required to be disposed in each of the electronic components 10, 10*a* and 10*b*. Thus, the electronic components 10, 10*a* and 10*b* are not always required to include a common-mode choke coil. Each of the electronic components 10, 10*a* and 10*b* may include other circuit elements, e.g., a capacitor and a resistance, in addition to the coil(s). Those circuit elements may constitute a circuit, such as a filter. In that case, between the coil L1 and the relay conductors 21 and 22, the circuit elements other than the coil L1 are present. Stated in another way, the coil L1 and the relay conductors 21 and 22 are just required to be electrically connected, and they are not required to be physically directly connected.

In each of the electronic components 10, 10*a* and 10*b*, the upper ends of the relay conductors 21, 22, 26 and 27 may be directly contacted with the magnetic substrate 12*b*.

While the relay conductor layers 21*a*, 21*b*, 22*a* to 22*c*, 26*a*, 26*b* and 27*a* to 27*c* have been described as having the shape of a substantially isosceles right triangle when viewed from above, they may have a suitable one of other shapes including a substantially rectangular shape.

The organic adhesive layer 19 is not always required to be disposed.

While the coils L1 and L2 have been described as being disposed inside the multilayer body 14, they are just required to be disposed in a state held by the multilayer body 14. In other words, the coils L1 and L2 may be partly disposed on the surface of the multilayer body 14, or may project outward from the multilayer body 14.

The total number of layers in the multilayer body 14 is not limited to three. Similarly, the number of coil conductor layers represented by 20 and 25 is not limited to two. The number of outer electrodes represented by 15*a* to 15*d* is not limited to four, and it may be two, for example.

While the four relay conductors 21, 22, 26 and 27 are disposed in the above examples, the number of the relay conductors represented by 21, 22, 26 and 27 is also not limited to four. It is just required that at least one of the relay conductors 21, 22, 26 and 27 is disposed. In that case, the at least one of the relay conductors 21, 22, 26 and 27 is one example of the first relay conductor.

While the insulator layer 18*c* is contacted with all the relay conductors 21, 22, 26 and 27 from below in the above examples, the insulator layer 18*c* is just required to be contacted with at least one of the relay conductors 21, 22, 26 and 27 from below.

As described above, the present disclosure is usefully applied to the electronic component and the manufacturing method for the electronic component. In particular, the present disclosure is superior in that a relay conductor disposed in a multilayer body on a ceramic substrate can be suppressed from slipping off from the multilayer body.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a first ceramic substrate having a substantially rectangular first principal surface that is positioned on one side in a laminating direction, and a substantially rectangular second principal surface that is positioned on the other side in the laminating direction;

a multilayer body constituted by a plurality of substantially rectangular parallelepiped insulator layers each made of a material containing resin or glass, the plurality of insulator layers being laminated on the first principal surface in the laminating direction;

a first coil disposed in and/or on the multilayer body;

a first relay conductor disposed in and/or on the multilayer body and electrically connected to the first coil; and a first outer electrode disposed on one surface of the first ceramic substrate and electrically connected to the first relay conductor, wherein the plurality of insulator layers include one or more first insulator layers in each of which a first corner has a shape cut away as a first cut-away portion, the first relay conductor is disposed in the first cut-away portion, and the plurality of insulator layers include a second insulator layer positioned along the laminating direction between the first ceramic substrate and the first relay conductor, the second insulator layer being in contact with the first relay conductor from a side of the first relay conductor facing the first principal surface of the first ceramic substrate in the laminating direction.

2. The electronic component according to claim 1, wherein the plurality of insulator layers further include a third insulator layer that is contacted with the first relay conductor from the one side in the laminating direction.

3. The electronic component according to claim 1, wherein the first ceramic substrate has a shape that a ridge overlapping the first relay conductor when viewed in the laminating direction is cut away as a second cut-away portion, the second cut-away portion reaches the multilayer body such that the first relay conductor partly constitutes a peripheral surface of the second cut-away portion, and the first outer electrode is disposed on the peripheral surface of the second cut-away portion such that the first outer electrode is electrically connected to the first relay conductor.

4. The electronic component according to claim 1, further comprising:

a second relay conductor disposed in and/or on the multilayer body and electrically connected to the first coil; and a second outer electrode disposed on one surface of the first ceramic substrate and electrically connected to the second relay conductor, wherein the plurality of insulator layers include one or more fourth insulator layers in each of which a second corner has a shape cut away as a third cut-away portion, the second relay conductor is disposed in the third cut-away portion, and the second insulator layer is contacted with the second relay conductor from the other side in the laminating direction.

5. The electronic component according to claim 1, further comprising:

a second ceramic substrate that sandwiches the multilayer body between the second ceramic substrate and the first ceramic substrate in the laminating direction, wherein the first ceramic substrate and the second ceramic substrate are each made of a magnetic material.

6. The electronic component according to claim 1, wherein, when viewed in the laminating direction, a value of a ratio of an area of a region where the first relay conductor and the second insulator layer contact each other to an area of the first relay conductor is not less than about 0.42 and not more than about 0.82.

7. The electronic component according to claim 1, wherein the first relay conductor is not contacted with the first principal surface of the first ceramic substrate.

8. The electronic component according to claim 1, further comprising:

a second coil disposed in and/or on the multilayer body and constituting a common-mode choke coil in combination with the first coil.

9. The electronic component according to claim 8, further comprising:

a third relay conductor disposed in and/or on the multilayer body and electrically connected to the second coil; and a third outer electrode disposed on one surface of the first ceramic substrate and electrically connected to the third relay conductor, wherein the plurality of insulator layers include one or more fifth insulator layers in each of which a third corner has a shape cut away as a fourth cut-away portion, the third relay conductor is disposed in the fourth cut-away portion, and the second insulator layer is contacted with the third relay conductor from the other side in the laminating direction.

10. A method for manufacturing an electronic component comprising:

a first step of forming a mother multilayer body; and a second step of firing the mother multilayer body, to manufacture the electronic component comprising:

a first ceramic substrate having a substantially rectangular first principal surface that is positioned on one side in a laminating direction, and a substantially rectangular second principal surface that is positioned on the other side in the laminating direction;

a multilayer body constituted by a plurality of substantially rectangular parallelepiped insulator layers each made of a material containing resin or glass, the plurality of insulator layers being laminated on the first principal surface in the laminating direction;

a first coil disposed in and/or on the multilayer body;

a first relay conductor disposed in and/or on the multilayer body and electrically connected to the first coil; and a first outer electrode disposed on one surface of the first ceramic substrate and electrically connected to the first relay conductor, the plurality of insulator layers include one or more first insulator layers in each of which a first corner has a shape cut away as a first cut-away portion, the first relay conductor is disposed in the first cut-away portion, the plurality of insulator layers include a second insulator layer positioned along the laminating direction between the first ceramic substrate and the first relay conductor, the second insulator layer being in contact with the first relay conductor from a side of the first relay conductor facing the first principal surface of the first ceramic substrate in the laminating direction, and wherein the first step includes, on each of the first principal surfaces of the plurality of first ceramic substrates arrayed in a first mother substrate, forming a plurality of paste layers, which are to become the plurality of insulator layers, with use of a material containing glass, and forming a coil conductor layer that is to become the first coil and a relay conductor layer that is to become the first relay conductor, thus forming the mother multilayer body in which the plurality of green multilayer bodies in a state not yet fired are arrayed.

11. The manufacturing method according to claim 10, wherein, in the first step, after forming a first paste layer, which is to become the second insulator layer, on the first principal surface, a first relay conductor layer that is to become a part of the first relay conductor is formed on the first paste layer, the manufacturing method for the electronic component further comprises:

a third step of forming a through-hole penetrating respective regions of the first mother substrate and the second insulator layer, the respective regions overlapping the first relay conductor when viewed in the laminating direction;

a fourth step of forming a part of the outer electrode by forming a conductor layer on a peripheral surface of the through-hole; and a fifth step of cutting the first mother substrate, and in the third step, the through-hole is formed such that a part of a surface of the first relay conductor layer on the other side in the laminating direction is exposed to the through-hole.

* * * * *